US009583117B2

(12) United States Patent
Krishnan et al.

(10) Patent No.: US 9,583,117 B2
(45) Date of Patent: Feb. 28, 2017

(54) METHOD AND APPARATUS FOR ENCODING AND DECODING AUDIO SIGNALS

(75) Inventors: Venkatesh Krishnan, San Diego, CA (US); Vivek Rajendran, San Diego, CA (US); Ananthapadmanabhan A. Kandhadai, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 761 days.

(21) Appl. No.: 11/915,834

(22) PCT Filed: Oct. 8, 2007

(86) PCT No.: PCT/US2007/080744
§ 371 (c)(1),
(2), (4) Date: Nov. 28, 2007

(87) PCT Pub. No.: WO2008/045846
PCT Pub. Date: Apr. 17, 2008

(65) Prior Publication Data

US 2009/0187409 A1 Jul. 23, 2009

Related U.S. Application Data

(60) Provisional application No. 60/828,816, filed on Oct. 10, 2006, provisional application No. 60/942,984, filed on Jun. 8, 2007.

(51) Int. Cl.
*G10L 19/00* (2013.01)
*G10L 21/00* (2013.01)
(Continued)

(52) U.S. Cl.
CPC ..... *G10L 19/20* (2013.01)

(58) Field of Classification Search
USPC ..... 704/210, 211, 216, 219, 222
See application file for complete search history.

(56) References Cited

U.S. PATENT DOCUMENTS 5,109,417 A 4/1992 Fielder et al.
5,414,796 A 5/1995 Jacobs et al.
(Continued)

FOREIGN PATENT DOCUMENTS

EP 0932141 7/1999
EP 1278184 1/2003
(Continued)

OTHER PUBLICATIONS

Davies et al, "Simple mixture model for sparse overcomplete ICA," Vision, Image and Signal Processing, IEE Proceedings-, vol. 151, No. 1, pp. 35-43, Feb. 5, 2004.*
(Continued)

*Primary Examiner* — Olujimi Adesanya
(74) *Attorney, Agent, or Firm* — Espartaco Diaz Hidalgo

(57) ABSTRACT

Techniques for efficiently encoding an input signal are described. In one design, a generalized encoder encodes the input signal (e.g., an audio signal) based on at least one detector and multiple encoders. The at least one detector may include a signal activity detector, a noise-like signal detector, a sparseness detector, some other detector, or a combination thereof. The multiple encoders may include a silence encoder, a noise-like signal encoder, a time-domain encoder, a transform-domain encoder, some other encoder, or a combination thereof. The characteristics of the input signal may be determined based on the at least one detector. An encoder may be selected from among the multiple encoders based on the characteristics of the input signal. The input signal may be encoded based on the selected encoder.
(Continued)

The input signal may include a sequence of frames, and detection and encoding may be performed for each frame.

35 Claims, 11 Drawing Sheets

(51) Int. Cl.

| | |
|---|---|
| ***G10L 19/12*** | (2013.01) |
| ***G10L 21/04*** | (2013.01) |
| ***G10L 19/20*** | (2013.01) |

(56) References Cited

U.S. PATENT DOCUMENTS

| | | | | |
|---|---|---|---|---|
| 5,461,421 | A * | 10/1995 | Moon | 375/240.13 |
| 5,488,665 | A * | 1/1996 | Johnston et al. | 381/2 |
| 5,684,829 | A * | 11/1997 | Kizuki et al. | 375/242 |
| 5,978,756 | A * | 11/1999 | Walker et al. | 704/210 |
| 5,982,817 | A * | 11/1999 | Wuppermann | 375/244 |
| 5,999,899 | A * | 12/1999 | Robinson | 704/222 |
| 6,134,518 | A * | 10/2000 | Cohen et al. | 704/201 |
| 6,324,505 | B1 * | 11/2001 | Choy et al. | 704/230 |
| 6,438,518 | B1 | 8/2002 | Manjunath et al. | |
| 6,456,964 | B2 | 9/2002 | Manjunath et al. | |
| 6,463,407 | B2 | 10/2002 | Das et al. | |
| 6,484,138 | B2 | 11/2002 | DeJaco | |
| 6,640,209 | B1 | 10/2003 | Das | |
| 6,697,430 | B1 * | 2/2004 | Yasunari et al. | 375/240.13 |
| 6,785,645 | B2 | 8/2004 | Khalil et al. | |
| 6,807,526 | B2 * | 10/2004 | Touimi et al. | 704/222 |
| 6,978,236 | B1 * | 12/2005 | Liljeryd et al. | 704/219 |
| 7,039,581 | B1 * | 5/2006 | Stachurski et al. | 704/205 |
| 7,454,330 | B1 | 11/2008 | Nishiguchi et al. | |
| 2002/0013703 | A1 * | 1/2002 | Matsumoto et al. | 704/234 |
| 2002/0111798 | A1 * | 8/2002 | Huang | 704/220 |
| 2003/0004711 | A1 * | 1/2003 | Koishida et al. | 704/223 |
| 2003/0009325 | A1 * | 1/2003 | Kirchherr et al. | 704/211 |
| 2003/0061035 | A1 * | 3/2003 | Kadambe | 704/203 |
| 2003/0101050 | A1 * | 5/2003 | Khalil et al. | 704/216 |
| 2003/0105624 | A1 * | 6/2003 | Yokoyama | 704/201 |
| 2004/0109471 | A1 * | 6/2004 | Minde et al. | 370/465 |
| 2004/0117176 | A1 * | 6/2004 | Kandhadai et al. | 704/223 |
| 2004/0133419 | A1 * | 7/2004 | El-Maleh et al. | 704/205 |
| 2004/0140916 | A1 | 7/2004 | Ji | |
| 2004/0260542 | A1 * | 12/2004 | Ananthapadmanabhan et al. | 704/219 |
| 2005/0096898 | A1 * | 5/2005 | Singhal | 704/205 |
| 2005/0119880 | A1 | 6/2005 | Manjunath | |
| 2006/0161427 | A1 * | 7/2006 | Ojala | 704/219 |
| 2007/0106502 | A1 * | 5/2007 | Kim et al. | 704/207 |
| 2007/0174051 | A1 * | 7/2007 | Oh et al. | 704/211 |

FOREIGN PATENT DOCUMENTS

| | | | |
|---|---|---|---|
| JP | 2000267699 | A | 9/2000 |
| JP | 2000347693 | A | 12/2000 |
| JP | 2003044097 | A | 2/2003 |
| JP | 2004004710 | A | 1/2004 |
| JP | 2004088255 | A | 3/2004 |
| JP | 2007017905 | A | 1/2007 |
| JP | 2009524846 | A | 7/2009 |
| KR | 20030001071 | | 1/2003 |
| RU | 2233010 | | 7/2004 |
| RU | 2004100072 | A | 6/2005 |
| WO | WO9510890 | | 4/1995 |
| WO | WO9903097 | A2 | 1/1999 |
| WO | 02065457 | | 8/2002 |

OTHER PUBLICATIONS

L. Daudet, "Sparse and structured decompositions of audio signals in overcomplete spaces", Proc. 7th Int. Conf. Digital Audio Effects, pp. 22 2004.*

Athineos et al, "Sound texture modelling with linear prediction in both time and frequency domains," Acoustics, Speech, and Signal Processing, 2003. Proceedings. (ICASSP '03). 2003 IEEE International Conference on , vol. 5, No., pp. V-648-V-651 vol. 5, Apr. 6-10, 2003.*

Database Inspec [Online] The Institution of Electrical Engineers, Stevenage,GB; Nov. 14, 2003, Te-Won Lee et al: "Sparse representation in speech signal processing" XP002464167.

Mike Davies: "PhD studentship in Sparse Representations in Audio" TSI ENST, [Online] 2005, XP002464166, Retrieved from the Internet: URL: http://www.tsi.enst.fr/icacentral/icalistArchive/2005/0981.html> [retrieved on Jan. 8, 2008.

Murthi M N et al: "Towards a synergistic multistage speech coder" Acoustics, Speech and Signal Processing, 1998. Proceedings of the 1998 IEEE International Conference on Seattle, WA, USA May 12-15, 1998, pp. 369-372, XP010279047.

Rufiner et al: "Statistical method for sparse coding of speech including a linear predictive model" Physical A, North-Holland, Amsterdam, NL, vol. 367, Jul. 15, 2006, pp. 231-251, XP005430299.

International Search Report—PCT/US2007/080744, International Search Authority—European Patent Office—Mar. 17, 2008.

Cheng, M. et al., "Fast IMDCT and MDCT Algorithms—A Matrix Approach," IEEE Transactions on Signal Processing, [see also IEEE Transactions on Acoustics, Speech, and Signal Processing,] vol. 51, No. 1, Jan. 2003, pp. 221-229.

Princen, J. et al., "Analysis/Synthesis Filter Bank Design Based on Time Domain Aliasing Cancellation," IEEE Transactions on Acoustics, Speech, and Signal Processing [see also IEEE Transactions on Signal Processing], vol. 34, No. 5, Oct. 1986, pp. 1153-1161.

Princen, J. et al., "Subband/Transform Coding Using Filter Bank Designs Based on Time Domain Aliasing Cancellation," IEEE International Conference on Acoustics, Speech, and Signal Processing ("ICASSP '87"), vol. 12, Apr. 1987, pp. 2161-2164.

Rao, K.R. et al., "Discrete Cosine Transform Algorithms, Advantages, Applications." Academic Press, Inc., San Diego, CA, 1990, ch. 2, pp. 7-25.

Tremain, T. et al., "A 4.8 KBPS Code Excited Linear Predictive Coder," Proceedings of the Mobile Satellite Conference, 1988, pp. 491-496.

Rabiner, L.R. et al., "Digital Processing of Speech Signals," Prentice Hall, Inc., Englewood, N.J., ch. 8, "Linear Predictive Coding of Speech." 1978. pp. 396-455.

Kleijn, W.B. et al., "Fast Methods for the CELP Speech Coding Algorithm," IEEE Transactions on Acoustics, Speech, and Signal Processing [see also IEEE Transactions on Signal Processing], vol. 38, No. 8, Aug. 1990, pp. 1330-1342.

DeJaco, A. et al., "QCELP: The North American CDMA Digital Cellular Variable Rate Speech Coding Standard," IEEE Workshop on Speech Coding for Telecommunications, Oct. 13-15, 1993, pp. 5-6.

Gersho, A., "Advances in Speech and Audio Compression," Proceedings of the IEEE, vol. 82, No. 6, Jun. 1994, pp. 900-918.

Chung, W.S., et al., "Design of a Variable Rate Algorithm for the 8 kb/s CS-ACELP Coder," 48th IEEE Vehicular Technology Conference ("VTC 98"), vol. 3, May 18-21, 1998, pp. 2378-2382.

Das, A. et al., "Multimode and Variable-Rate Coding of Speech," in "Speech Coding and Synthesis," ch. 7, eds. Kleijn et al., Elsevier Science, B.V., The Netherlands, 1995, pp. 257-288.

Das, A. et al., Multimode Variable Bit Rate Speech Coding: An Efficient Paradigm for High-Quality Low-Rate Representation of Speech Signal, 1999 IEEE International Conference on Acoustics, Speech, and Signal Processing, vol. 4, Mar. 15-19, 1999, pp. 2307-2310.

Greer, S.C. et al., Standardization of the Selectable Mode Vocoder, IEEE International Conference on Acoustics, Speech, and Signal Processing ("ICASSP '01"), vol. 2, May 7-11, 2001, pp. 953-956.

Taniguchi, T. et al., "Speech Coding with Dynamic Bit Allocation (Multimode Coding)," in Atal B.S., "Advances in Speech Coding," Atal B.S. (eds), Kluwer Academic Press, Norwell, Mass., ch. 15, Dec. 31, 1990, pp. 157-166.

Kleijn, W.B. et al., "Methods for Waveform Interpolation in Speech Coding," Digital Signal Processing 1, 1991, pp. 215-230.

(56) References Cited

OTHER PUBLICATIONS

Rabiner, et al., "Fundamentals of Speech Recognition," ch. 3, Prentice Hall 1993, pp. 69-140.
Kroon, P., et al., "Linear Prediction based Analysis-by-Synthesis Coding," in "Speech Coding and Synthesis," ch. 3, eds. Kleijn et al., Elsevier Science, B.V., The Netherlands, 1995, pp. 79-119.
McAulay, R.J., et al., "Sinusoidal Coding," in "Speech Coding and Sythesis," ch. 4, eds. Kleijn et al., Elsevier Science, B.V., The Netherlands, 1995, pp. 121-173.
Gersho, A. et al., "Vector Quantization and Signal Compression," ch. 4, "Linear Prediction," Kluwer Academic Publishers, Norwell, Mass, pp. 83-129.
Gersho, A. et al., "Vector Quantization and Signal Compression," ch. 13, "Predictive Vector Quantization." Kluwer Academic Publishers, Norwell, Mass, pp. 487-517.
Kubin, G. et al., "Performance of Noise Excitation for Unvoiced Speech," IEEE Workshop on Speech Coding for Telecommunications, Oct. 13-15, 1993, pp. 35-36.
3rd Generation Partnership Project 2 ("3GPP2"), "Enhanced Variable Rate Codec, Speech Service Option 3 and 68 for Wideband Spread Spectrum Digital Systems," 3GPP2 C.S0014-B, ver. 1.0, May 2006, section 4.11, pp. 4-128 to 4-132.
De Martin, J.C., et al, "Mixed-Domain Coding of Speech at 3 KB/S," IEEE International Conference on Acoustics, Speech, and Signal Processing, vol. 1, May 7-10, 1996, pp. 216-219.
Written Opinion—PCT/US2007/080744, International Search Authority, European Patent Office, Mar. 17, 2008.
G.722.2 Annex A: Comfort noise aspects, Series G: Transmission Systems and Media, Digital Systems and Networks, ITU-T, Jan. 2002, 3 pages.
European Search Report—EP12000494 Search Authority—The Hague Patent Office, Sep. 5, 2012.

* cited by examiner

METHOD AND APPARATUS FOR ENCODING AND DECODING AUDIO SIGNALS

The present application is the National Stage of International Application No. PCT/US2007/080744, filed Oct. 8, 2007, which claims the benefit of Provisional Application Ser. No. 60/828,816, entitled "A FRAMEWORK FOR ENCODING GENERALIZED AUDIO SIGNALS," filed Oct. 10, 2006, and Provisional Application Ser. No. 60/942,984, entitled "METHOD AND APPARATUS FOR ENCODING AND DECODING AUDIO SIGNALS," filed Jun. 8, 2007, both assigned to the assignee hereof and incorporated herein by reference.

BACKGROUND

Field

The present disclosure relates generally to communication, and more specifically to techniques for encoding and decoding audio signals.

Background

Audio encoders and decoders are widely used for various applications such as wireless communication, Voice-over-Internet Protocol (VoIP), multimedia, digital audio, etc. An audio encoder receives an audio signal at an input bit rate, encodes the audio signal based on a coding scheme, and generates a coded signal at an output bit rate that is typically lower (and sometimes much lower) than the input bit rate. This allows the coded signal to be sent or stored using fewer resources.

An audio encoder may be designed based on certain presumed characteristics of an audio signal and may exploit these signal characteristics in order to use as few bits as possible to represent the information in the audio signal. The effectiveness of the audio encoder may then be dependent on how closely an actual audio signal matches the presumed characteristics for which the audio encoder is designed. The performance of the audio encoder may be relatively poor if the audio signal has different characteristics than those for which the audio encoder is designed.

SUMMARY

Techniques for efficiently encoding an input signal and decoding a coded signal are described herein. In one design, a generalized encoder may encode an input signal (e.g., an audio signal) based on at least one detector and multiple encoders. The at least one detector may comprise a signal activity detector, a noise-like signal detector, a sparseness detector, some other detector, or a combination thereof. The multiple encoders may comprise a silence encoder, a noise-like signal encoder, a time-domain encoder, at least one transform-domain encoder, some other encoder, or a combination thereof. The characteristics of the input signal may be determined based on the at least one detector. An encoder may be selected from among the multiple encoders based on the characteristics of the input signal. The input signal may then be encoded based on the selected encoder. The input signal may comprise a sequence of frames. For each frame, the signal characteristics of the frame may be determined, an encoder may be selected for the frame based on its characteristics, and the frame may be encoded based on the selected encoder.

In another design, a generalized encoder may encode an input signal based on a sparseness detector and multiple encoders for multiple domains. Sparseness of the input signal in each of the multiple domains may be determined. An encoder may be selected from among the multiple encoders based on the sparseness of the input signal in the multiple domains. The input signal may then be encoded based on the selected encoder. The multiple domains may include time domain and transform domain. A time-domain encoder may be selected to encode the input signal in the time domain if the input signal is deemed more sparse in the time domain than the transform domain. A transform-domain encoder may be selected to encode the input signal in the transform domain (e.g., frequency domain) if the input signal is deemed more sparse in the transform domain than the time domain.

In yet another design, a sparseness detector may perform sparseness detection by transforming a first signal in a first domain (e.g., time domain) to obtain a second signal in a second domain (e.g., transform domain). First and second parameters may be determined based on energy of values/components in the first and second signals. At least one count may also be determined based on prior declarations of the first signal being more sparse and prior declarations of the second signal being more sparse. Whether the first signal or the second signal is more sparse may be determined based on the first and second parameters and the at least one count, if used.

Various aspects and features of the disclosure are described in further detail below.

DETAILED DESCRIPTION

Various types of audio encoders may be used to encode audio signals. Some audio encoders may be capable of encoding different classes of audio signals such as speech, music, tones, etc. These audio encoders may be referred to as general-purpose audio encoders. Some other audio encoders may be designed for specific classes of audio signals such as speech, music, background noise, etc. These audio encoders may be referred to as signal class-specific audio encoders, specialized audio encoders, etc. In general, a signal class-specific audio encoder that is designed for a specific class of audio signals may be able to more efficiently encode an audio signal in that class than a general-purpose audio encoder. Signal class-specific audio encoders may be able to achieve improved source coding of audio signals of specific classes at bit rates as low as 8 kilobits per second (Kbps).

A generalized audio encoder may employ a set of signal class-specific audio encoders in order to efficiently encode generalized audio signals. The generalized audio signals may belong in different classes and/or may dynamically change class over time. For example, an audio signal may contain mostly music in some time intervals, mostly speech in some other time intervals, mostly noise in yet some other time intervals, etc. The generalized audio encoder may be able to efficiently encode this audio signal with different suitably selected signal class-specific audio encoders in different time intervals. The generalized audio encoder may be able to achieve good coding performance for audio signals of different classes and/or dynamically changing classes.

Figure 1:
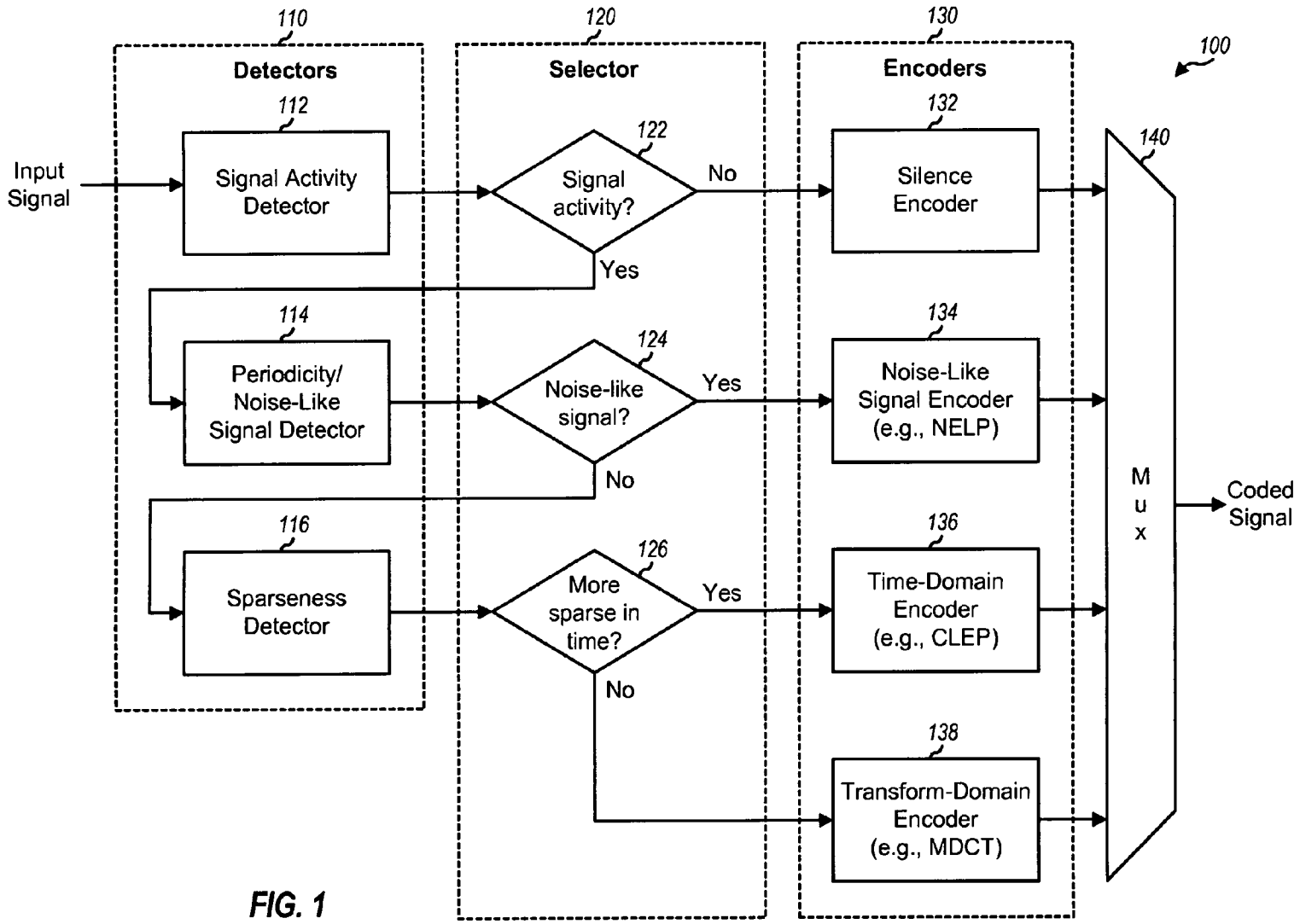
FIG. 1 shows a block diagram of a generalized audio encoder.

FIG. 1 shows a block diagram of a design of a generalized audio encoder 100 that is capable of encoding an audio signal with different and/or changing characteristics. Audio encoder 100 includes a set of detectors 110, a selector 120, a set of signal class-specific audio encoders 130, and a multiplexer (Mux) 140. Detectors 110 and selector 120 provide a mechanism to select an appropriate class-specific audio encoder based on the characteristics of the audio signal. The different signal class-specific audio encoders may also be referred to as different coding modes.

Within audio encoder 100, a signal activity detector 112 may detect for activity in the audio signal. If signal activity is not detected, as determined in block 122, then the audio signal may be encoded based on a silence encoder 132, which may be efficient at encoding mostly noise.

If signal activity is detected, then a detector 114 may detect for periodic and/or noise-like characteristics of the audio signal. The audio signal may have noise-like characteristics if it is not periodic, has no predictable structure or pattern, has no fundamental (pitch) period, etc. For example, the sound of the letter 's' may be considered as having noise-like characteristics. If the audio signal has noise-like characteristics, as determined in block 124, then the audio signal may be encoded based on a noise-like signal encoder 134. Encoder 134 may implement a Noise Excited Linear Prediction (NELP) technique and/or some other coding technique that can efficiently encode a signal having noise-like characteristics.

If the audio signal does not have noise-like characteristics, then a sparseness detector 116 may analyze the audio signal to determine whether the signal demonstrates sparseness in time domain or in one or more transform domains. The audio signal may be transformed from the time domain to another domain (e.g., frequency domain) based on a transform, and the transform domain refers to the domain to which the audio signal is transformed. The audio signal may be transformed to different transform domains based on different types of transform. Sparseness refers to the ability to represent information with few bits. The audio signal may be considered to be sparse in a given domain if only few values or components for the signal in that domain contain most of the energy or information of the signal.

If the audio signal is sparse in the time domain, as determined in block 126, then the audio signal may be encoded based on a time-domain encoder 136. Encoder 136 may implement a Code Excited Linear Prediction (CELP) technique and/or some other coding technique that can efficiently encode a signal that is sparse in the time domain. Encoder 136 may determine and encode residuals of long-term and short-term predictions of the audio signal. Otherwise, if the audio signal is sparse in one of the transform domains and/or coding efficiency is better in one of the transform domains than the time domain and other transform domains, then the audio signal may be encoded based on a transform-domain encoder 138. A transform-domain encoder is an encoder that encodes a signal, whose transform domain representation is sparse, in a transform domain. Encoder 138 may implement a Modified Discrete Cosine Transform (MDCT), a set of filter banks, sinusoidal modeling, and/or some other coding technique that can efficiently represent sparse coefficients of signal transform.

Multiplexer 140 may receive the outputs of encoders 132, 134, 136 and 138 and may provide the output of one encoder as a coded signal. Different ones of encoders 132, 134, 136 and 138 may be selected in different time intervals based on the characteristics of the audio signal.

FIG. 1 shows a specific design of generalized audio encoder 100. In general, a generalized audio encoder may include any number of detectors and any type of detector that may be used to detect for any characteristics of an audio signal. The generalized audio encoder may also include any number of encoders and any type of encoder that may be used to encode the audio signal. Some example detectors and encoders are given above and are known by those skilled in the art. The detectors and encoders may be arranged in various manners. FIG. 1 shows one example set of detectors and encoders in one example arrangement. A generalized audio encoder may include fewer, more and/or different encoders and detectors than those shown in FIG. 1.

The audio signal may be processed in units of frames. A frame may include data collected in a predetermined time interval, e.g., 10 milliseconds (ms), 20 ms, etc. A frame may also include a predetermined number of samples at a predetermined sample rate. A frame may also be referred to as a packet, a data block, a data unit, etc.

Generalized audio encoder 100 may process each frame as shown in FIG. 1. For each frame, signal activity detector 12 may determine whether that frame contains silence or activity. If a silence frame is detected, then silence encoder 132 may encode the frame and provide a coded frame. Otherwise, detector 114 may determine whether the frame contains noise-like signal and, if yes, encoder 134 may encode the frame. Otherwise, either encoder 136 or 138 may encode the frame based on the detection of sparseness in the frame by detector 116. Generalized audio encoder 100 may select an appropriate encoder for each frame in order to maximize coding efficiency (e.g., achieve good reconstruction quality at low bit rates) while enabling seamless transition between different encoders.

While the description below describes sparseness detectors that enable selection between time domain and a transform domain, the design below may be generalized to select one domain from among time domain and any number of transform domains. Likewise, the encoders in the generalized audio coders may include any number and any type of transform-domain encoders, one of which may be selected to encode the signal or a frame of the signal.

In the design shown in FIG. 1, sparseness detector 116 may determine whether the audio signal is sparse in the time domain or the transform domain. The result of this determination may be used to select time-domain encoder 136 or transform-domain encoder 138 for the audio signal. Since sparse information may be represented with fewer bits, the sparseness criterion may be used to select an efficient encoder for the audio signal. Sparseness may be detected in various manners.

Figure 2:
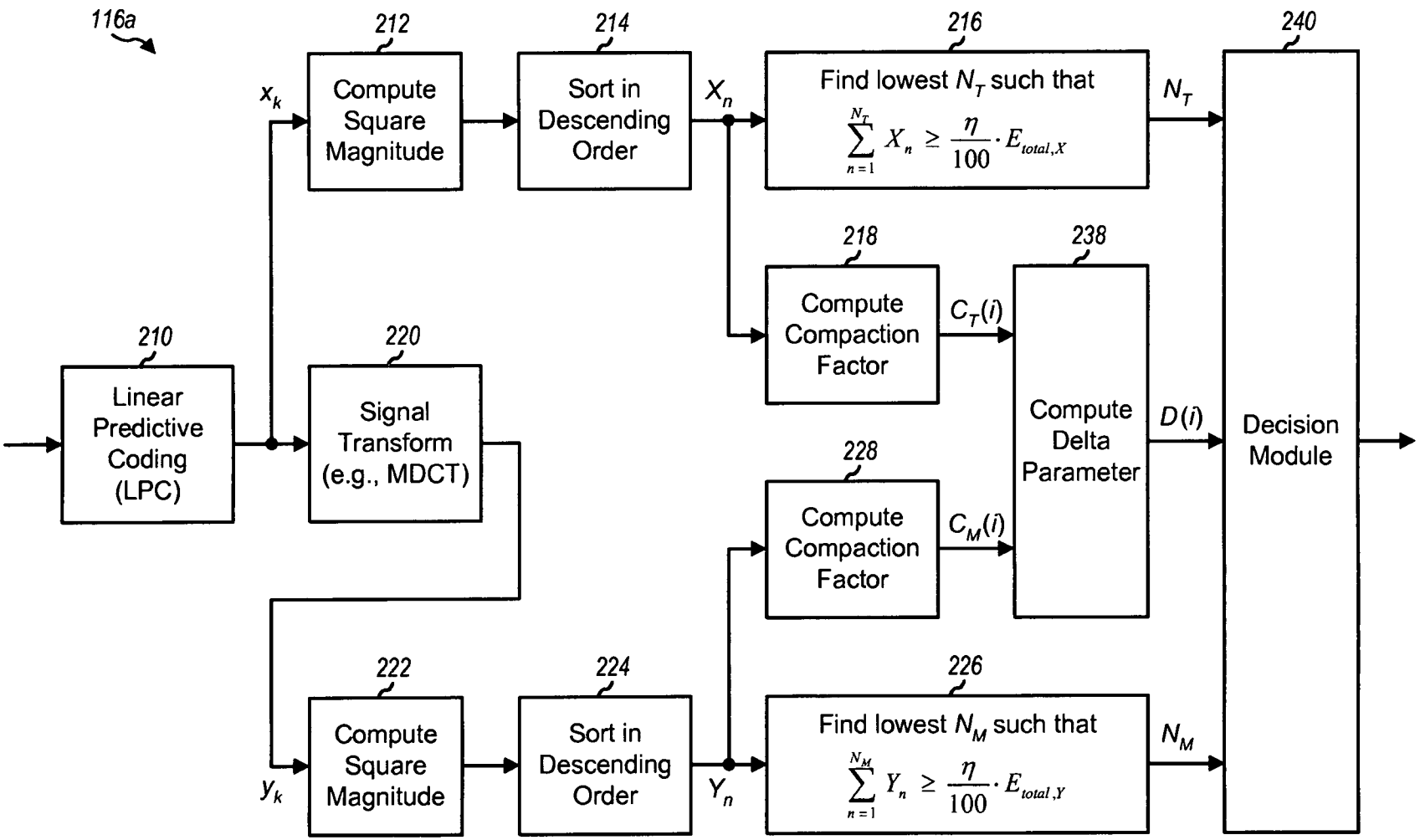
FIG. 2 shows a block diagram of a sparseness detector.

FIG. 2 shows a block diagram of a sparseness detector 116*a*, which is one design of sparseness detector 116 in FIG. 1. In this design, sparseness detector 116*a* receives an audio frame and determines whether the audio frame is more sparse in the time domain or the transform domain.

In the design shown in FIG. 2, a unit 210 may perform Linear Predictive Coding (LPC) analysis in the vicinity of the current audio frame and provide a frame of residuals. The vicinity typically includes the current audio frame and may further include past and/or future frames. For example, unit 210 may derive a predicted frame based on samples in only the current frame, or the current frame and one or more past frames, or the current frame and one or more future frames, or the current frame, one or more past frames, and one or more future frames, etc. The predicted frame may also be derived based on the same or different numbers of samples in different frames, e.g., 160 samples from the current frame, 80 samples from the next frame, etc. In any case, unit 210 may compute the difference between the current audio frame and the predicted frame to obtain a residual frame containing the differences between the current and predicted frames. The differences are also referred to as residuals, prediction errors, etc.

The current audio frame may contain K samples and may be processed by unit 210 to obtain the residual frame containing K residuals, where K may be any integer value. A unit 220 may transform the residual frame (e.g., based on the same transform used by transform-domain encoder 138 in FIG. 1) to obtain a transformed frame containing K coefficients.

A unit 212 may compute the square magnitude or energy of each residual in the residual frame, as follows:

$$|x_k|^2=x_{i,k}^2+x_{q,k}^2, \quad \text{Eq (1)}$$

where $x_k=x_{i,k}+j\,x_{q,k}$ is the k-th complex-valued residual in the residual frame, and $|x_k|^2$ is the square magnitude or energy of the k-th residual.

Unit 212 may filter the residuals and then compute the energy of the filtered residuals. Unit 212 may also smooth and/or re-sample the residual energy values. In any case, unit 212 may provide N residual energy values in the time domain, where $N \le K$.

A unit 214 may sort the N residual energy values in descending order, as follows:

$$X_1 \ge X_2 \ge \ldots \ge X_N, \quad \text{Eq (2)}$$

where $X_1$ is the largest $|x_k|^2$ value, $X_2$ is the second largest $|x_k|^2$ value, etc., and $X_N$ is the smallest $|x_k|^2$ value among the $N|x_k|^2$ values from unit 212.

A unit 216 may sum the N residual energy values to obtain the total residual energy. Unit 216 may also accumulate the N sorted residual energy values, one energy value at a time, until the accumulated residual energy exceeds a predetermined percentage of the total residual energy, as follows:

$$E_{total,X} = \sum_{n=1}^{N} X_n, \quad \text{Eq (3a)}$$

$$\sum_{n=1}^{N_T} X_n \ge \frac{\eta}{100} \cdot E_{total,X}, \quad \text{Eq (3b)}$$

where $E_{total,X}$ is the total energy of all N residual energy values, $\eta$ is the predetermined percentage, e.g., $\eta=70$ or some other value, and $N_T$ is the minimum number of residual energy values with accumulated energy exceeding $\eta$ percent of the total residual energy.

A unit 222 may compute the square magnitude or energy of each coefficient in the transformed frame, as follows:

$$|y_k|^2=y_{i,k}^2+y_{q,k}^2, \quad \text{Eq (4)}$$

where $y_k=y_{i,k}+j\,y_{q,k}$ is the k-th coefficient in the transformed frame, and $|y_k|^2$ is the square magnitude or energy of the k-th coefficient.

Unit 222 may operate on the coefficients in the transformed frame in the same manner as unit 212. For example, unit 222 may smooth and/or re-sample the coefficient energy values. Unit 222 may provide N coefficient energy values.

A unit 224 may sort the N coefficient energy values in descending order, as follows:

$$Y_1 \ge Y_2 \ge \ldots \ge Y_N, \quad \text{Eq (5)}$$

where $Y_1$ is the largest $|y_k|^2$ value, $Y_2$ is the second largest $|y_k|^2$ value, etc., and $Y_N$ is the smallest $|y_k|^2$ value among the $N|y_k|^2$ values from unit 222.

A unit 226 may sum the N coefficient energy values to obtain the total coefficient energy. Unit 226 may also accumulate the N sorted coefficient energy values, one energy value at a time, until the accumulated coefficient energy exceeds the predetermined percentage of the total coefficient energy, as follows:

$$E_{total,Y} = \sum_{n=1}^{N} Y_n, \quad \text{Eq (6a)}$$

$$\sum_{n=1}^{N_M} Y_n \ge \frac{\eta}{100} \cdot E_{total,Y}, \quad \text{Eq (6b)}$$

where $E_{total,Y}$ is the total energy of all N coefficient energy values, and $N_M$ is the minimum number of coefficient energy values with accumulated energy exceeding $\eta$ percent of the total coefficient energy.

Units 218 and 228 may compute compaction factors for the time domain and transform domain, respectively, as follows:

$$C_T(i) = \frac{\sum_{n=1}^{i} X_n}{E_{total,X}}, \quad \text{Eq (7a)}$$

$$C_M(i) = \frac{\sum_{n=1}^{i} Y_n}{E_{total,Y}}, \quad \text{Eq (7b)}$$

where $C_T(i)$ is a compaction factor for the time domain, and $C_M(i)$ is a compaction factor for the transform domain.

$C_T(i)$ is indicative of the aggregate energy of the top i residual energy values. $C_T(i)$ may be considered as a cumulative energy function for the time domain. $C_M(i)$ is indicative of the aggregate energy of the top i coefficient energy values. $C_M(i)$ may be considered as a cumulative energy function for the transform domain.

A unit 238 may compute a delta parameter D(i) based on the compaction factors, as follows:

$$D(i)=C_M(i)-C_T(i) \quad \text{Eq (8)}$$

A decision module 240 may receive parameters $N_T$ and $N_M$ from units 216 and 226, respectively, the delta parameter D(i) from unit 238, and possibly other information. Decision module 240 may select either time-domain encoder 136 or transform-domain encoder 138 for the current frame based on $N_T$, $N_M$, D(i) and/or other information.

In one design, decision module 240 may select time-domain encoder 136 or transform-domain encoder 138 for the current frame, as follows:

$$\text{If } N_T<(N_M-Q_1) \text{ then select time-domain encoder } \mathbf{136}, \quad \text{Eq (9a)}$$

$$\text{If } N_M<(N_T-Q_2) \text{ then select transform-domain encoder } \mathbf{138}, \quad \text{Eq (9b)}$$

where $Q_1$ and $Q_2$ are predetermined thresholds, e.g., $Q_1 \geq 0$ and $Q_2 \geq 0$.

$N_T$ may be indicative of the sparseness of the residual frame in the time domain, with a smaller value of $N_T$ corresponding to a more sparse residual frame, and vice versa. Similarly, $N_M$ may be indicative of the sparseness of the transformed frame in the transform domain, with a smaller value of $N_M$ corresponding to a more sparse transformed frame, and vice versa. Equation (9a) selects time-domain encoder 136 if the time-domain representation of the residuals is more sparse, and equation (9b) selects transform-domain encoder 138 if the transform-domain representation of the residuals is more sparse.

The selection in equation set (9) may be undetermined for the current frame. This may be the case, e.g., if $N_T=N_M$, $Q_1>0$, and/or $Q_2>0$. In this case, one or more additional parameters such as D(i) may be used to determine whether to select time-domain encoder 136 or transform-domain encoder 138 for the current frame. For example, if equation set (9) alone is not sufficient to select an encoder, then transform-domain encoder 138 may be selected if D(i) is greater than zero, and time-domain encoder 136 may be selected otherwise.

Thresholds $Q_1$ and $Q_2$ may be used to achieve various effects. For example, thresholds $Q_1$ and/or $Q_2$ may be selected to account for differences or bias (if any) in the computation of $N_T$ and $N_M$. Thresholds $Q_1$ and/or $Q_2$ may also be used to (i) favor time-domain encoder 136 over transform-domain encoder 138 by using a small $Q_1$ value and/or a large $Q_2$ value or (ii) favor transform-domain encoder 138 over time-domain encoder 136 by using a small $Q_2$ value and/or a large $Q_1$ value. Thresholds $Q_1$ and/or $Q_2$ may also be used to achieve hysteresis in the selection of encoder 136 or 138. For example, if time-domain encoder 136 was selected for the previous frame, then transform-domain encoder 138 may be selected for the current frame if $N_M$ is smaller than $N_T$ by $Q_2$, where $Q_2$ is the amount of hysteresis in going from encoder 136 to encoder 138. Similarly, if transform-domain encoder 138 was selected for the previous frame, then time-domain encoder 136 may be selected for the current frame if $N_T$ is smaller than $N_M$ by $Q_1$, where $Q_1$ is the amount of hysteresis in going from encoder 138 to encoder 136. The hysteresis may be used to change encoder only if the signal characteristics have changed by a sufficient amount, where the sufficient amount may be defined by appropriate choices of $Q_1$ and $Q_2$ values.

In another design, decision module 240 may select time-domain encoder 136 or transform-domain encoder 138 for the current frame based on initial decisions for the current and past frames. In each frame, decision module 240 may make an initial decision to use time-domain encoder 136 or transform-domain encoder 138 for that frame, e.g., as described above. Decision module 240 may then switch from one encoder to another encoder based on a selection rule. For example, decision module 240 may switch to another encoder only if $Q_3$ most recent frames prefer the switch, if $Q_4$ out of $Q_5$ most recent frames prefer the switch, etc., where $Q_3$, $Q_4$, and $Q_5$ may be suitably selected values. Decision module 240 may use the current encoder for the current frame if a switch is not made. This design may provide time hysteresis and prevent continual switching between encoders in consecutive frames.

Figure 3:
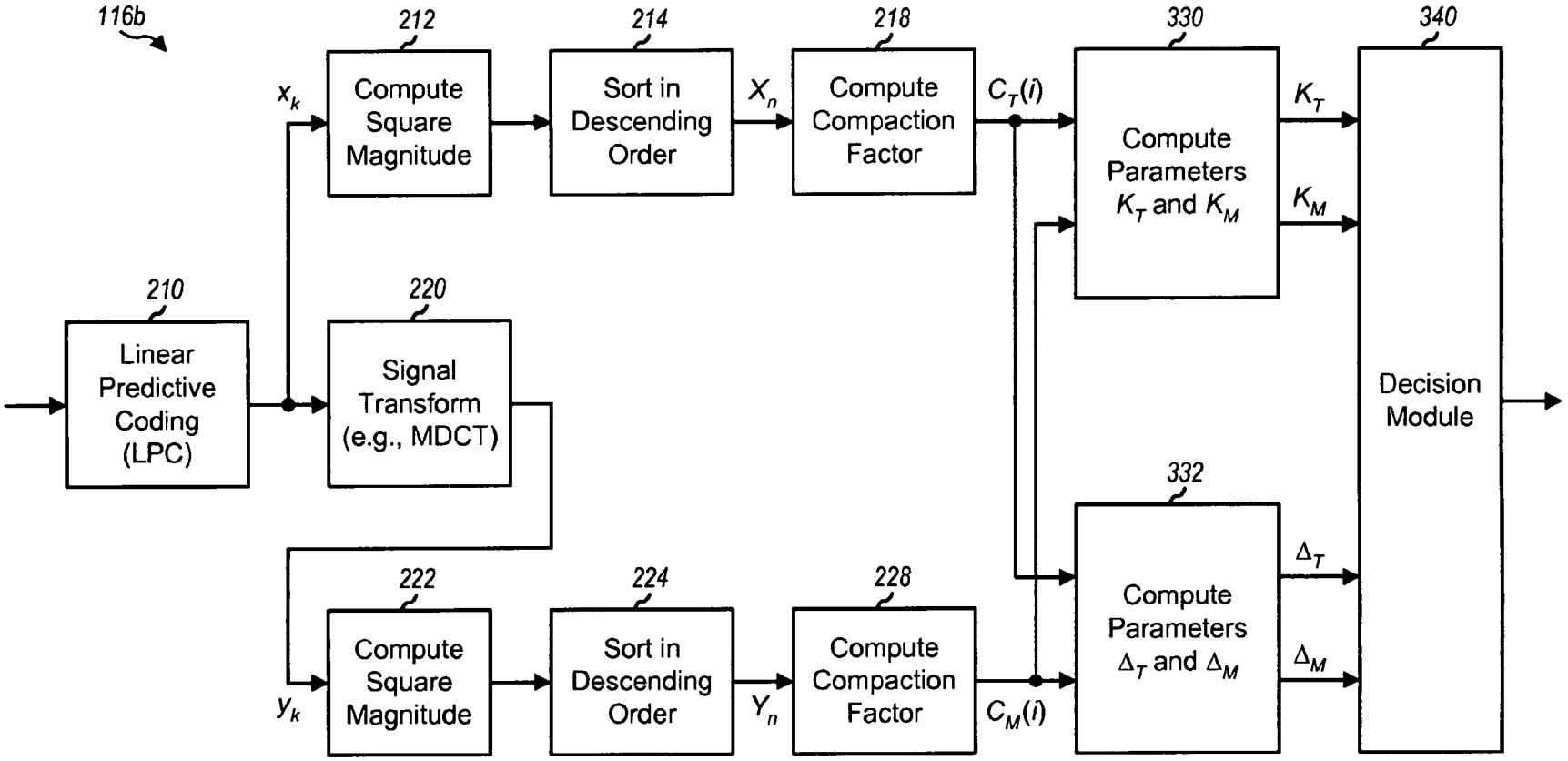
FIG. 3 shows a block diagram of another sparseness detector.

FIG. 3 shows a block diagram of a sparseness detector 116*b*, which is another design of sparseness detector 116 in FIG. 1. In this design, sparseness detector 116*b* includes units 210, 212, 214, 218, 220, 222, 224 and 228 that operate as described above for FIG. 2 to compute compaction factor $C_T(i)$ for the time domain and compaction factor $C_M(i)$ for the transform domain.

A unit 330 may determine the number of times that $C_T(i) \geq C_M(i)$ and the number of times that $C_M(i) \geq C_T(i)$, for all values of $C_T(i)$ and $C_M(i)$ up to a predetermined value, as follows:

$$K_T=\text{cardinality}\{C_T(i):C_T(i)\geq C_M(i), \text{ for } 1\leq i\leq N \text{ and } C_T(i)\leq\tau\}, \quad \text{Eq (10a)}$$

$$K_M=\text{cardinality}\{C_M(i):C_M(i)\geq C_T(i), \text{ for } 1\leq i\leq N \text{ and } C_M(i)\leq\tau\}, \quad \text{Eq (10b)}$$

where $K_T$ is a time-domain sparseness parameter, $K_M$ is a transform-domain sparseness parameter, and $\tau$ is the percentage of total energy being considered to determine $K_T$ and $K_M$.

The cardinality of a set is the number of elements in the set.

In equation (10a), each time-domain compaction factor $C_T(i)$ is compared against a corresponding transform-domain compaction factor $C_M(i)$, for i=1, . . . , N and $C_T(i)\leq\tau$. For all time-domain compaction factors that are compared, the number of time-domain compaction factors that are greater than or equal to the corresponding transform-domain compaction factors is provided as $K_T$.

In equation (10b), each transform-domain compaction factor $C_M(i)$ is compared against a corresponding time-domain compaction factor $C_T(i)$, for i=1, . . . , N and $C_M(i)\leq\tau$. For all transform-domain compaction factors that are compared, the number of transform-domain compaction factors that are greater than or equal to the corresponding time-domain compaction factors is provided as $K_M$.

A unit 332 may determine parameters $\Delta_T$ and $\Delta_M$, as follows:

$$\Delta_T=\Sigma\{C_T(i)-C_M(i)\}, \text{ for } all\ C_T(i)>C_M(i),\ 1\leq i\leq N, \text{ and } C_T(i)\leq\tau\}, \quad \text{Eq (11a)}$$

$$\Delta_M=\Sigma\{C_M(i)-C_T(i)\}, \text{ for } all\ C_M(i)>C_T(i),\ 1\leq i\leq N, \text{ and } C_M(i)\leq\tau\}. \quad \text{Eq (11b)}$$

$K_T$ is indicative of how many times $C_T(i)$ meets or exceeds $C_M(i)$, and $\Delta_T$ is indicative of the aggregate amount that $C_T(i)$ exceeds $C_M(i)$ when $C_T(i)>C_M(i)$. $K_M$ is indicative of how many times $C_M(i)$ meets or exceeds $C_T(i)$, and $\Delta_M$ is indicative of the aggregate amount that $C_M(i)$ exceeds $C_T(i)$ when $C_M(i)>C_T(i)$.

A decision module 340 may receive parameters $K_T$, $K_M$, $\Delta_T$ and $\Delta_M$ from units 330 and 332 and may select either time-domain encoder 136 or transform-domain encoder 138 for the current frame. Decision module 340 may maintain a time-domain history count $H_T$ and a transform-domain history count $H_M$. Time-domain history count $H_T$ may be increased whenever a frame is deemed more sparse in the time domain and decreased whenever a frame is deemed more sparse in the transform domain. Transform-domain history count $H_M$ may be increased whenever a frame is deemed more sparse in the transform domain and decreased whenever a frame is deemed more sparse in the time domain.

Figure 4A:
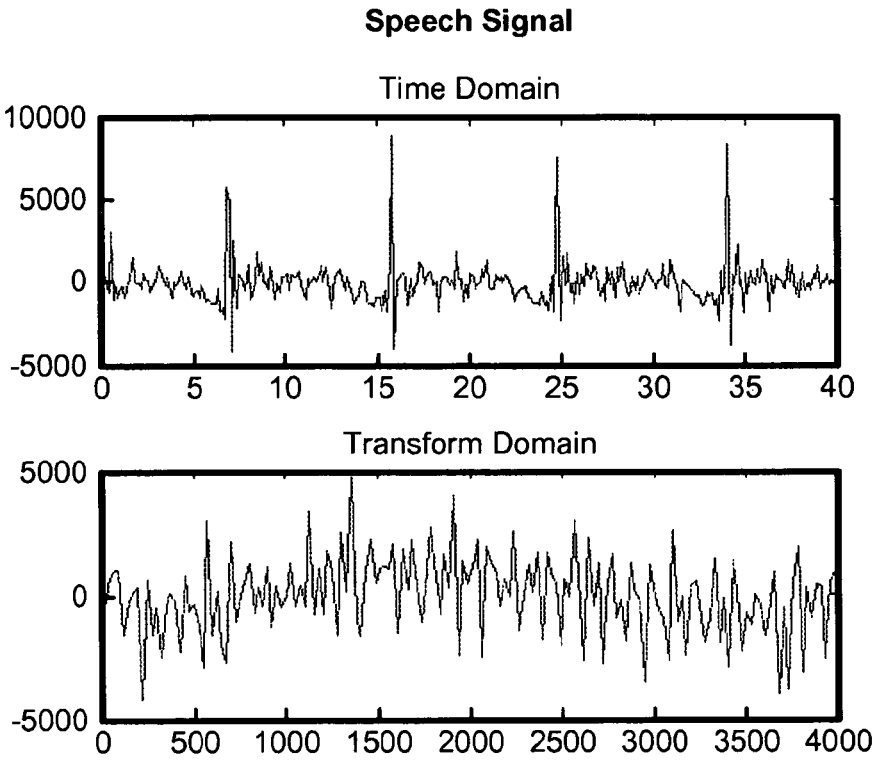
FIGS. 4A and 4B show plots of a speech signal and an instrumental music signal in the time domain and the transform domain.

FIG. 4A shows plots of an example speech signal in the time domain and the transform domain, e.g., MDCT domain. In this example, the speech signal has relatively few large values in the time domain but many large values in the transform domain. This speech signal is more sparse in the time domain and may be more efficiently encoded based on time-domain encoder 136.

Figure 4B:
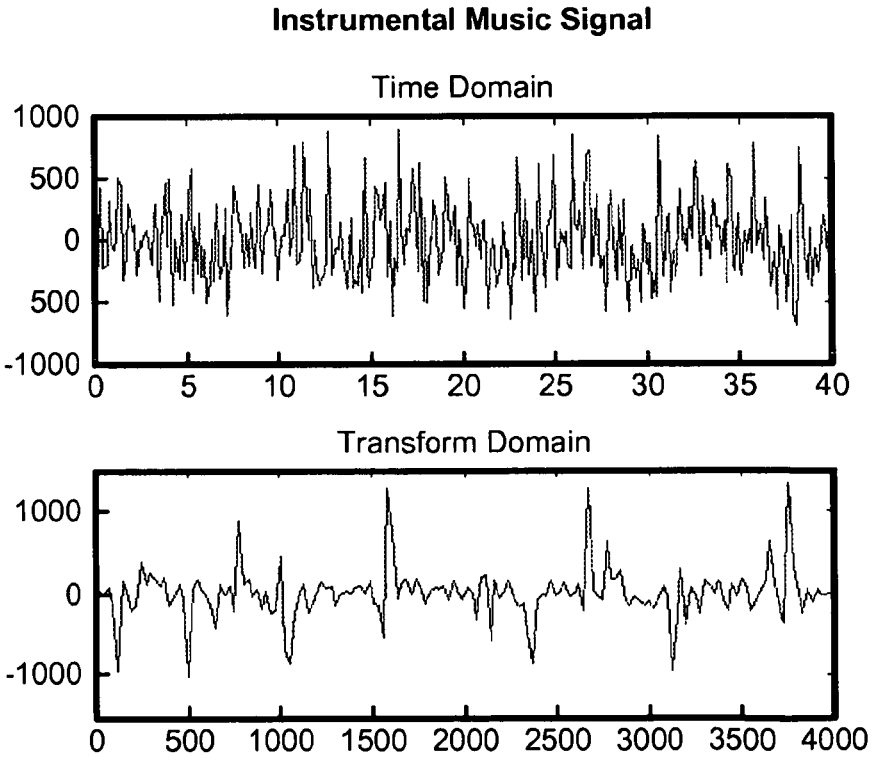

FIG. 4B shows plots of an example instrumental music signal in the time domain and the transform domain, e.g., the MDCT domain. In this example, the instrumental music signal has many large values in the time domain but fewer large values in the transform domain. This instrumental music signal is more sparse in the transform domain and may be more efficiently encoded based on transform-domain encoder 138.

Figure 5A:
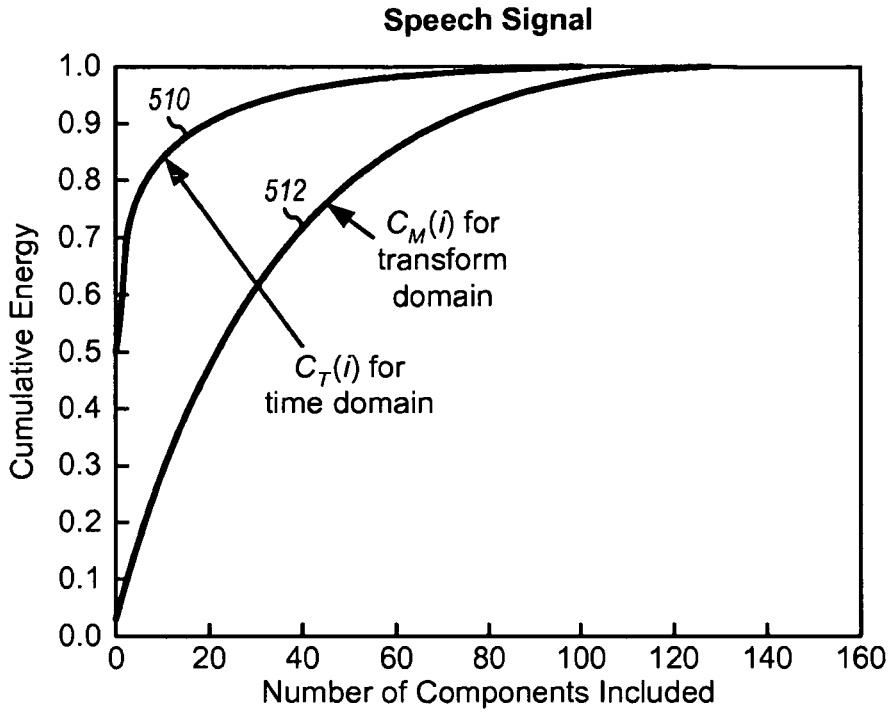
FIGS. 5A and 5B show plots for time-domain and transform-domain compaction factors for the speech signal and the instrumental music signal.

FIG. 5A shows a plot 510 for time-domain compaction factor $C_T(i)$ and a plot 512 for transform-domain compaction factor $C_M(i)$ for the speech signal shown in FIG. 4A. Plots 510 and 512 indicate that a given percentage of the total energy may be captured by fewer time-domain values than transform-domain values.

Figure 5B:
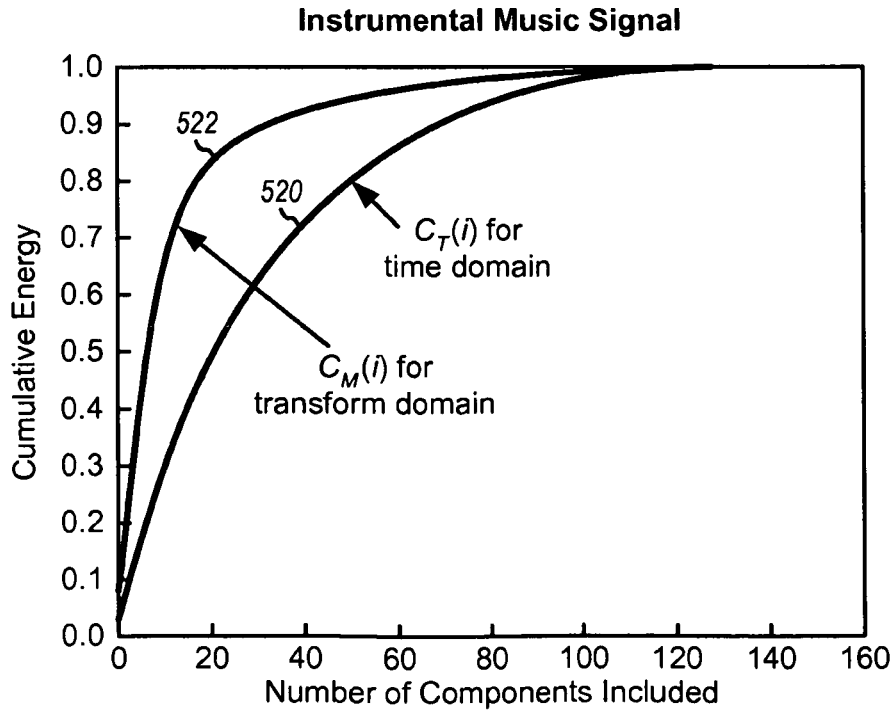

FIG. 5B shows a plot 520 for time-domain compaction factor $C_T(i)$ and a plot 522 for transform-domain compaction factor $C_M(i)$ for the instrumental music signal shown in FIG. 4B. Plots 520 and 522 indicate that a given percentage of the total energy may be captured by fewer transform-domain values than time-domain values.

Figure 6A:
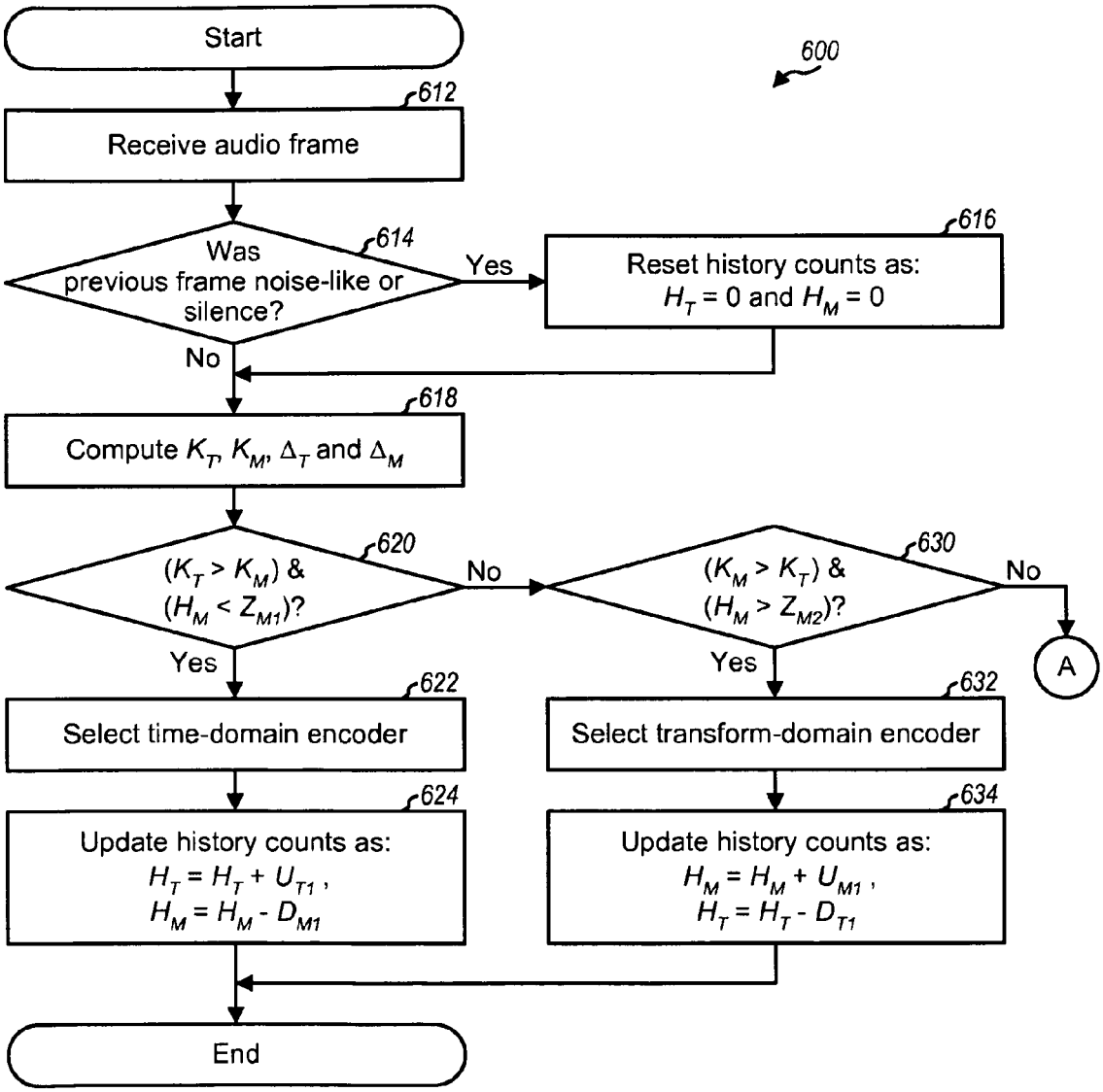
FIGS. 6A and 6B show a process for selecting either a time-domain encoder or a transform-domain encoder for an audio frame.
Figure 6B:
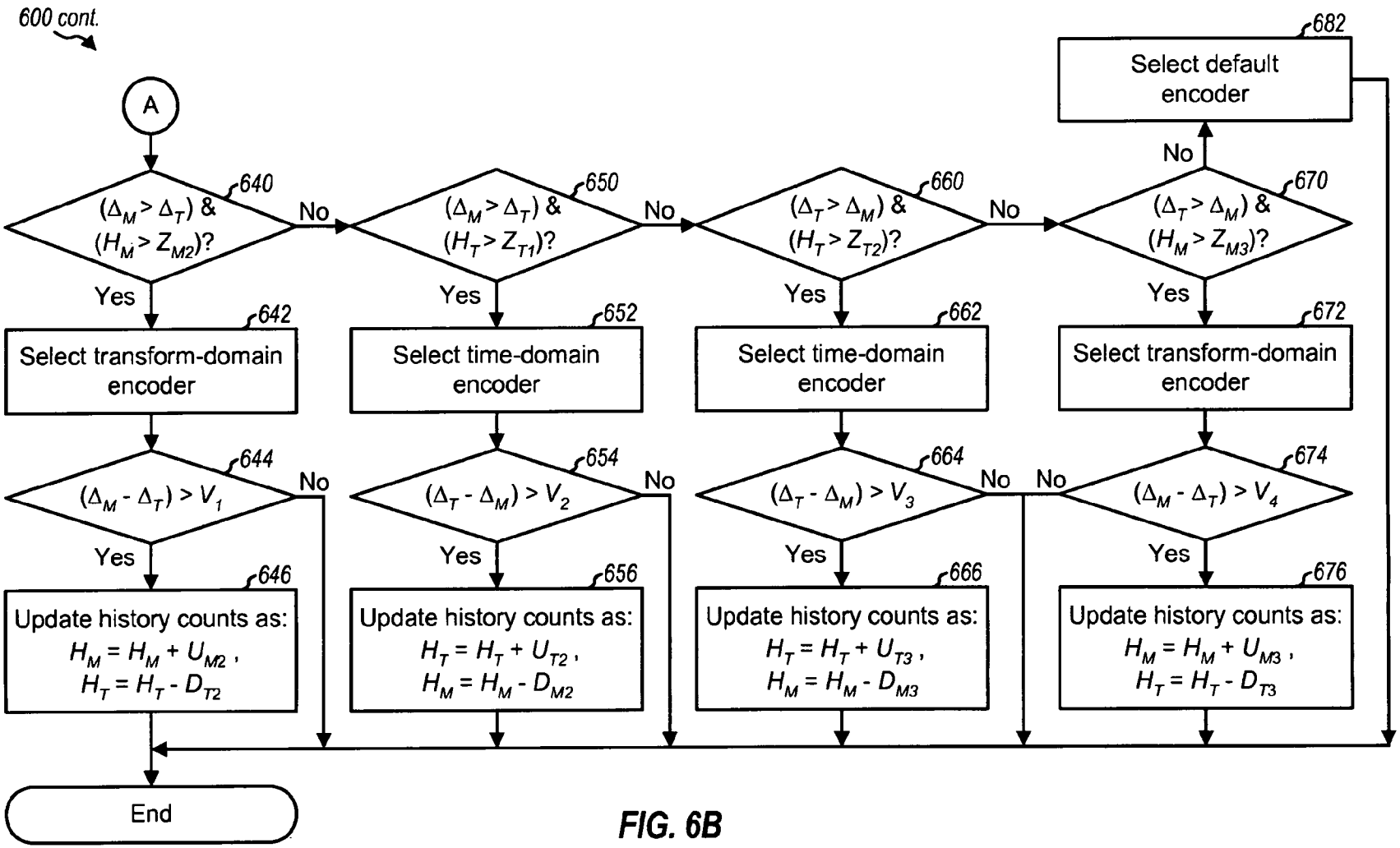

FIGS. 6A and 6B show a flow diagram of a design of a process 600 for selecting either time-domain encoder 136 or transform-domain encoder 138 for an audio frame. Process 600 may be used for sparseness detector 116*b* in FIG. 3. In the following description, $Z_{T1}$ and $Z_{T2}$ are threshold values against which time-domain history count $H_T$ is compared, and $Z_{M1}$, $Z_{M2}$, $Z_{M3}$ are threshold values against which transform-domain history count $H_M$ is compared. $U_{T1}$, $U_{T2}$ and $U_{T3}$ are increment amounts for $H_T$ when time-domain encoder 136 is selected, and $U_{M1}$, $U_{M2}$ and $U_{M3}$ are increment amounts for $H_M$ when transform-domain encoder 138 is selected. The increment amounts may be the same or different values. $D_{T1}$, $D_{T2}$ and $D_{T3}$ are decrement amounts for $H_T$ when transform-domain encoder 138 is selected, and $D_{M1}$, $D_{M2}$ and $D_{M3}$ are decrement amounts for $H_M$ when time-domain encoder 136 is selected. The decrement amounts may be the same or different values. $V_1$, $V_2$, $V_3$ and $V_4$ are threshold values used to decide whether or not to update history counts $H_T$ and $H_M$.

In FIG. 6A, an audio frame to encode is initially received (block 612). A determination is made whether the previous audio frame was a silence frame or a noise-like signal frame (block 614). If the answer is 'Yes', then the time-domain and transform-domain history counts are reset as $H_T=0$ and $H_M=0$ (block 616). If the answer is 'No' for block 614 and also after block 616, parameters $K_T$, $K_M$, $\Delta_T$ and $\Delta_M$ are computed for the current audio frame as described above (block 618).

A determination is then made whether $K_T>K_M$ and $H_M<Z_{M1}$ (block 620). Condition $K_T>K_M$ may indicate that the current audio frame is more sparse in the time domain than the transform domain. Condition $H_M<Z_{M1}$ may indicate that prior audio frames have not been strongly sparse in the transform domain. If the answer is 'Yes' for block 620, then time-domain encoder 136 is selected for the current audio frame (block 622). The history counts may then be updated in block 624, as follows:

$$H_T=H_T+U_{T1} \text{ and } H_M=H_M-D_{M1}. \quad \text{Eq (12)}$$

If the answer is 'No' for block 620, then a determination is made whether $K_M>K_T$ and $H_M>Z_{M2}$ (block 630). Condition $K_M>K_T$ may indicate that the current audio frame is more sparse in the transform domain than the time domain. Condition $H_M>Z_{M2}$ may indicate that prior audio frames have been sparse in the transform domain. The set of conditions for block 630 helps bias the decision towards selecting time-domain encoder 138 more frequently. The second condition in block may be replaced with $H_T>Z_{T1}$ to match block 620. If the answer is 'Yes' for block 630, then transform-domain encoder 138 is selected for the current audio frame (block 632). The history counts may then be updated in block 634, as follows:

$$H_M=H_M+U_{M1} \text{ and } H_T=H_T-D_{T1}. \quad \text{Eq (13)}$$

After blocks 624 and 634, the process terminates. If the answer is 'No' for block 630, then the process proceeds to FIG. 6B.

FIG. 6B may be reached if $K_T=K_M$ or if the history count conditions in blocks 620 and/or 630 are not satisfied. A determination is initially made whether $\Delta_M>\Delta_T$ and $H_M>Z_{M2}$ (block 640). Condition $\Delta_M>\Delta_T$ may indicate that the current audio frame is more sparse in the transform domain than the time domain. If the answer is 'Yes' for block 640, then transform-domain encoder 138 is selected for the current audio frame (block 642). A determination is then made whether $(\Delta_M-\Delta_T)>V_1$ (block 644). If the answer is 'Yes', then the history counts may be updated in block 646, as follows:

$$H_M=H_M+U_{M2} \text{ and } H_T=H_T-D_{T2}. \quad \text{Eq (14)}$$

If the answer is 'No' for block 640, then a determination is made whether $\Delta_M>\Delta_T$ and $H_T>Z_{T1}$ (block 650). If the answer is 'Yes' for block 650, then time-domain encoder 136 is selected for the current audio frame (block 652). A determination is then made whether $(\Delta_T-\Delta_M)>V_2$ (block 654). If the answer is 'Yes', then the history counts may be updated in block 656, as follows:

$$H_T=H_T+U_{T2} \text{ and } H_M=H_M-D_{M2}. \quad \text{Eq (15)}$$

If the answer is 'No' for block 650, then a determination is made whether $\Delta_T>\Delta_M$ and $H_T>Z_{T2}$ (block 660). Condition $\Delta_T>\Delta_M$ may indicate that the current audio frame is more sparse in the time domain than the transform domain. If the answer is 'Yes' for block 660, then time-domain encoder 136 is selected for the current audio frame (block 662). A determination is then made whether $(\Delta_T-\Delta_M)>V_3$ (block 664). If the answer is 'Yes', then the history counts may be updated in block 666, as follows:

$$H_T=H_T+U_{T3} \text{ and } H_M=H_M-D_{M3}. \quad \text{Eq (16)}$$

If the answer is 'No' for block 660, then a determination is made whether $\Delta_T>\Delta_M$ and $H_M>Z_{M3}$ (block 670). If the answer is 'Yes' for block 670, then transform-domain encoder 138 is selected for the current audio frame (block 672). A determination is then made whether $(\Delta_M-\Delta_T)>V_4$ (block 674). If the answer is 'Yes', then the history counts may be updated in block 676, as follows:

$$H_M=H_M+U_{M3} \text{ and } H_T=H_T-D_{T3}. \quad \text{Eq (17)}$$

If the answer is 'No' for block 670, then a default encoder may be selected for the current audio frame (block 682). The default encoder may be the encoder used in the preceding audio frame, a specified encoder (e.g., either time-domain encoder 136 or transform-domain encoder 138), etc.

Various threshold values are used in process 600 to allow for tuning of the selection of time-domain encoder 136 or transform-domain encoder 138. The threshold values may be chosen to favor one encoder over another encoder in certain situations. In one example design, $Z_{M1}=Z_{M2}=Z_{T1}=Z_{T2}=4$, $U_{T1}=U_{M1}=2$, $D_{T1}=D_{M1}=1$, $V_1=V_2=V_3=V_4=1$, and $U_{M2}=D_{T2}=1$. Other threshold values may also be used for process 600.

FIGS. 2 through 6B show several designs of sparseness detector 116 in FIG. 1. Sparseness detection may also be performed in other manners, e.g., with other parameters. A sparseness detector may be designed with the following goals:

- Detection of sparseness based on signal characteristics to select time-domain encoder 136 or transform-domain encoder 138,
- Good sparseness detection for voiced speech signal frames, e.g., low probability of selecting transform-domain encoder 138 for a voiced speech signal frame,
- For audio frames derived from musical instruments such as violin, transform-domain encoder 138 should be selected for high percentage of the time,
- Minimize frequent switches between time-domain encoder 136 and transform-domain encoder 138 to reduce artifacts,
- Low complexity and preferably open loop operation, and
- Robust performance across different signal characteristics and noise conditions.

Figure 7:
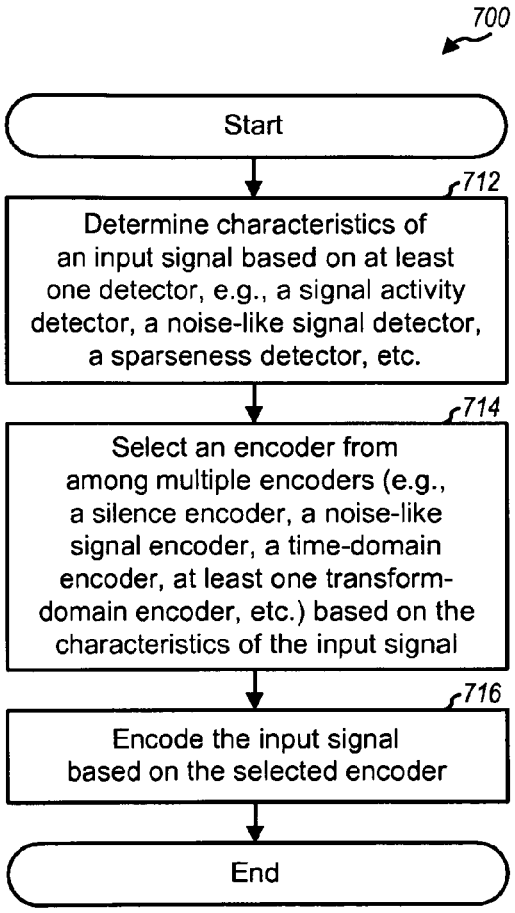
FIG. 7 shows a process for encoding an input signal with a generalized encoder.

FIG. 7 shows a flow diagram of a process 700 for encoding an input signal (e.g., an audio signal) with a generalized encoder. The characteristics of the input signal may be determined based on at least one detector, which may comprise a signal activity detector, a noise-like signal detector, a sparseness detector, some other detector, or a combination thereof (block 712). An encoder may be selected from among multiple encoders based on the characteristics of the input signal (block 714). The multiple encoders may comprise a silence encoder, a noise-like signal encoder (e.g., an NELP encoder), a time-domain encoder (e.g., a CELP encoder), at least one transform-domain encoder (e.g., an MDCT encoder), some other encoder, or a combination thereof. The input signal may be encoded based on the selected encoder (block 716).

For blocks 712 and 714, activity in the input signal may be detected, and the silence encoder may be selected if activity is not detected in the input signal. Whether the input signal has noise-like signal characteristics may be determined, and the noise-like signal encoder may be selected if the input signal has noise-like signal characteristics. Sparseness of the input signal in the time domain and at least one transform domain for the at least one transform-domain encoder may be determined. The time-domain encoder may be selected if the input signal is deemed more sparse in the time domain than the at least one transform domain. One of the at least one transform-domain encoder may be selected if the input signal is deemed more sparse in the corresponding transform domain than the time domain and other transform domains, if any. The signal detection and encoder selection may be performed in various orders.

The input signal may comprise a sequence of frames. The characteristics of each frame may be determined, and an encoder may be selected for the frame based on its signal characteristics. Each frame may be encoded based on the encoder selected for that frame. A particular encoder may be selected for a given frame if that frame and a predetermined number of preceding frames indicate a switch to that particular encoder. In general, the selection of an encoder for each frame may be based on any parameters.

Figure 8:
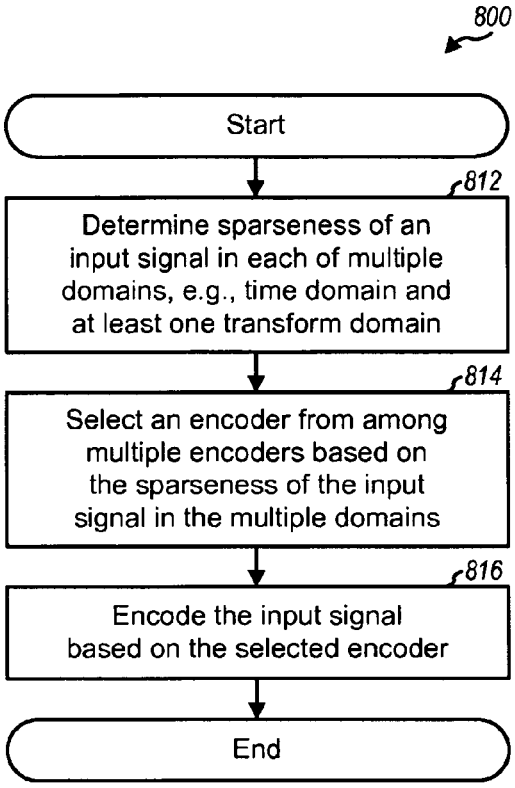
FIG. 8 shows a process for encoding an input signal with encoders for multiple domains.

FIG. 8 shows a flow diagram of a process 800 for encoding an input signal, e.g., an audio signal. Sparseness of the input signal in each of multiple domains may be determined, e.g., based on any of the designs described above (block 812). An encoder may be selected from among multiple encoders based on the sparseness of the input signal in the multiple domains (block 814). The input signal may be encoded based on the selected encoder (block 816).

The multiple domains may comprise time domain and at least one transform domain, e.g., frequency domain. Sparseness of the input signal in the time domain and the at least one transform domain may be determined based on any of the parameters described above, one or more history counts that may be updated based on prior selections of a time-domain encoder and prior selections of at least one transform-domain encoder, etc. The time-domain encoder may be selected to encode the input signal in the time domain if the input signal is determined to be more sparse in the time domain than the at least one transform domain. One of the at least one transform-domain encoder may be selected to encode the input signal in the corresponding transform domain if the input signal is determined to be more sparse in that transform domain than the time domain and other transform domains, if any.

Figure 9:
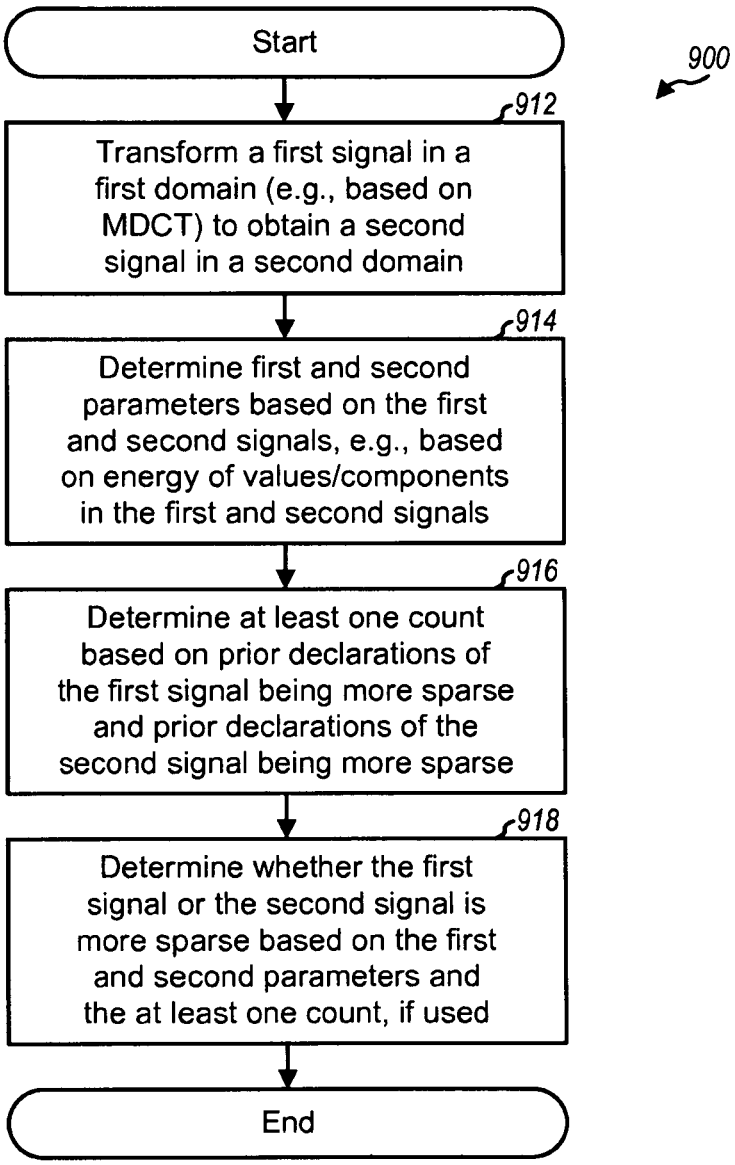
FIG. 9 shows a process for performing sparseness detection.

FIG. 9 shows a flow diagram of a process 900 for performing sparseness detection. A first signal in a first domain may be transformed (e.g., based on MDCT) to obtain a second signal in a second domain (block 912). The first signal may be obtained by performing Linear Predictive Coding (LPC) on an audio input signal. The first domain may be time domain, and the second domain may be transform domain, e.g., frequency domain. First and second parameters may be determined based on the first and second signals, e.g., based on energy of values/components in the first and second signals (block 914). At least one count may be determined based on prior declarations of the first signal being more sparse and prior declarations of the second signal being more sparse (block 916). Whether the first signal or the second signal is more sparse may be determined based on the first and second parameters and the at least one count, if used (block 918).

For the design shown in FIG. 2, the first parameter may correspond to the minimum number of values ($N_T$) in the first signal containing at least a particular percentage of the total energy of the first signal. The second parameter may correspond to the minimum number of values ($N_M$) in the second signal containing at least the particular percentage of the total energy of the second signal. The first signal may be deemed more sparse based on the first parameter being smaller than the second parameter by a first threshold, e.g., as shown in equation (9a). The second signal may be deemed more sparse based on the second parameter being smaller than the first parameter by a second threshold, e.g., as shown in equation (9b). A third parameter (e.g., $C_T(i)$) indicative of the cumulative energy of the first signal may be determined. A fourth parameter (e.g., $C_M(i)$) indicative of the cumulative energy of the second signal may also be determined. Whether the first signal or the second signal is more sparse may be determined further based on the third and fourth parameters.

For the design shown in FIGS. 3, 6A and 6B, a first cumulative energy function (e.g., $C_T(i)$) for the first signal and a second cumulative energy function (e.g., $C_M(i)$) for the second signal may be determined. The number of times that the first cumulative energy function meets or exceeds the second cumulative energy function may be provided as the first parameter (e.g., $K_T$). The number of times that the second cumulative energy function meets or exceeds the first cumulative energy function may be provided as the second parameter (e.g., $K_M$). The first signal may be deemed more sparse based on the first parameter being greater than the second parameter. The second signal may be deemed more sparse based on the second parameter being greater than the first parameter. A third parameter (e.g., $\Delta_T$) may be determined based on instances in which the first cumulative energy function exceeds the second cumulative energy function, e.g., as shown in equation (11a). A fourth parameter (e.g., $\Delta_M$) may be determined based on instances in which the second cumulative energy function exceeds the first cumulative energy function, e.g., as shown in equation (11b). Whether the first signal or the second signal is more sparse may be determined further based on the third and fourth parameters.

For both designs, a first count (e.g., $H_T$) may be incremented and a second count (e.g., $H_M$) may be decremented for each declaration of the first signal being more sparse. The first count may be decremented and the second count may be incremented for each declaration of the second signal being more sparse. Whether the first signal or the second signal is more sparse may be determined further based on the first and second counts.

Multiple encoders may be used to encode an audio signal, as described above. Information on how the audio signal is encoded may be sent in various manners. In one design, each coded frame includes encoder/coding information that indicates a specific encoder used for that frame. In another design, a coded frame includes encoder information only if the encoder used for that frame is different from the encoder used for the preceding frame. In this design, encoder information is only sent whenever a switch in encoder is made, and no information is sent if the same encoder is used. In general, the encoder may include symbols/bits within the coded information that informs the decoder which encoder is selected. Alternatively, this information may be transmitted separately using a side channel.

Figure 10:
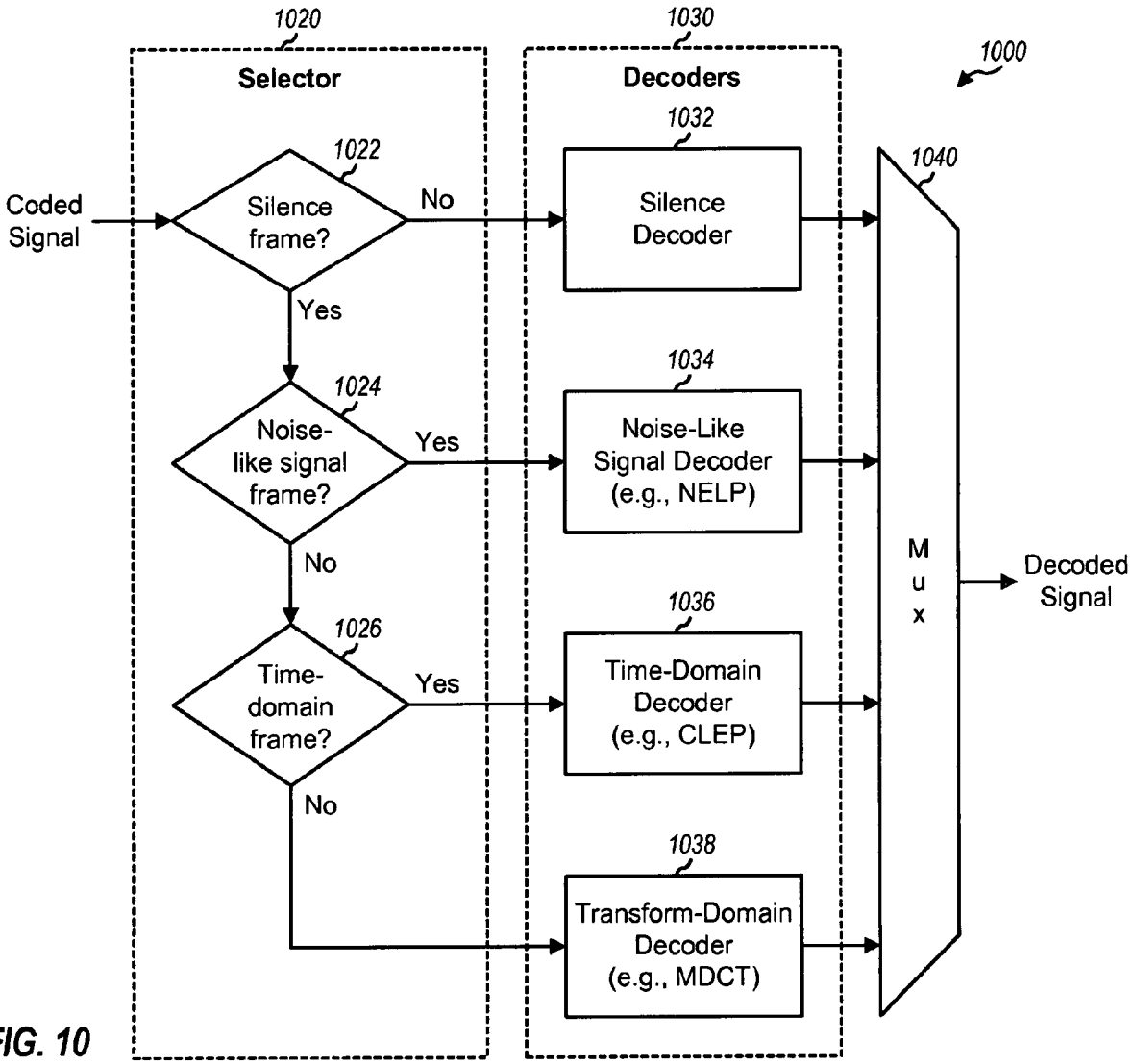
FIG. 10 shows a block diagram of a generalized audio decoder.

FIG. 10 shows a block diagram of a design of a generalized audio decoder 1000 that is capable of decoding an audio signal encoded with generalized audio encoder 100 in FIG. 1. Audio decoder 1000 includes a selector 1020, a set of signal class-specific audio decoders 1030, and a multiplexer 1040.

Within selector 1020, a block 1022 may receive a coded audio frame and determine whether the received frame is a silence frame, e.g., based on encoder information included in the frame. If the received frame is a silence frame, then a silence decoder 1032 may decode the received frame and provide a decoded frame. Otherwise, a block 1024 may determine whether the received frame is a noise-like signal frame. If the answer is 'Yes', then a noise-like signal decoder 1034 may decode the received frame and provide a decoded frame. Otherwise, a block 1026 may determine whether the received frame is a time-domain frame. If the answer is 'Yes', then a time-domain decoder 1036 may decode the received frame and provide a decoded frame. Otherwise, a transform-domain decoder 1038 may decode the received frame and provide a decoded frame. Decoders 1032, 1034, 1036 and 1038 may perform decoding in a manner complementary to the encoding performed by encoders 132, 134, 136 and 138, respectively, within generalized audio encoder 100 in FIG. 1. Multiplexer 1040 may receive the outputs of decoders 1032, 1034, 1036 and 1038 and may provide the output of one decoder as a decoded frame. Different ones of decoders 1032, 1034, 1036 and 1038 may be selected in different time intervals based on the characteristics of the audio signal.

FIG. 10 shows a specific design of generalized audio decoder 1000. In general, a generalized audio decoder may include any number of decoders and any type of decoder, which may be arranged in various manners. FIG. 10 shows one example set of decoders in one example arrangement. A generalized audio decoder may include fewer, more and/or different decoders, which may be arranged in other manners.

The encoding and decoding techniques described herein may be used for communication, computing, networking, personal electronics, etc. For example, the techniques may be used for wireless communication devices, handheld devices, gaming devices, computing devices, consumer electronics devices, personal computers, etc. An example use of the techniques for a wireless communication device is described below.

Figure 11:
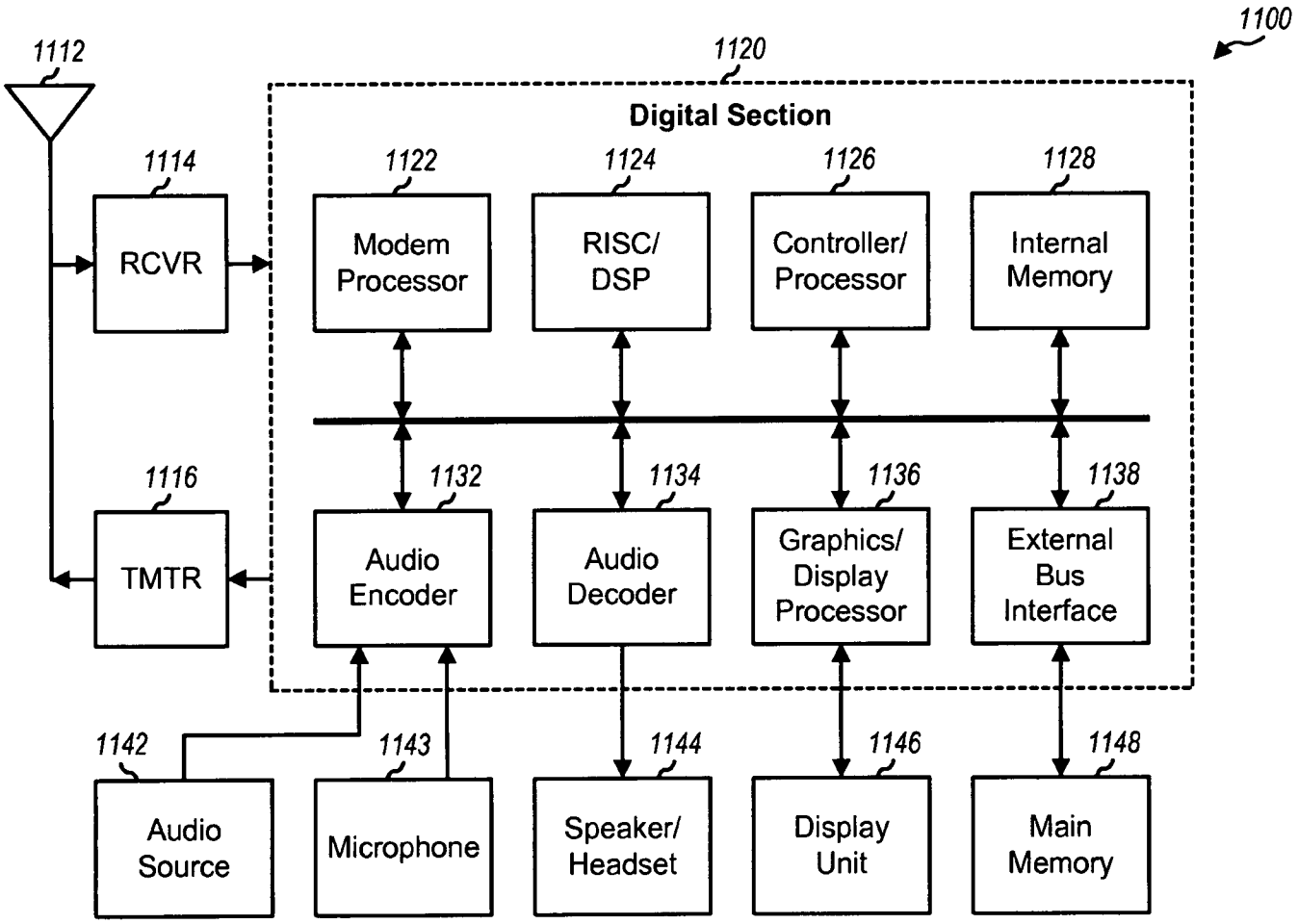
FIG. 11 shows a block diagram of a wireless communication device.

FIG. 11 shows a block diagram of a design of a wireless communication device 1100 in a wireless communication system. Wireless device 1100 may be a cellular phone, a terminal, a handset, a personal digital assistant (PDA), a wireless modem, a cordless phone, etc. The wireless communication system may be a Code Division Multiple Access (CDMA) system, a Global System for Mobile Communications (GSM) system, etc.

Wireless device 1100 is capable of providing bidirectional communication via a receive path and a transmit path. On the receive path, signals transmitted by base stations are received by an antenna 1112 and provided to a receiver (RCVR) 1114. Receiver 1114 conditions and digitizes the received signal and provides samples to a digital section 1120 for further processing. On the transmit path, a transmitter (TMTR) 1116 receives data to be transmitted from digital section 1120, processes and conditions the data, and generates a modulated signal, which is transmitted via antenna 1112 to the base stations. Receiver 1114 and transmitter 1116 may be part of a transceiver that may support CDMA, GSM, etc.

Digital section 1120 includes various processing, interface and memory units such as, for example, a modem processor 1122, a reduced instruction set computer/digital signal processor (RISC/DSP) 1124, a controller/processor 1126, an internal memory 1128, a generalized audio encoder 1132, a generalized audio decoder 1134, a graphics/display processor 1136, and an external bus interface (EBI) 1138. Modem processor 1122 may perform processing for data transmission and reception, e.g., encoding, modulation, demodulation, and decoding. RISC/DSP 1124 may perform general and specialized processing for wireless device 1100. Controller/processor 1126 may direct the operation of various processing and interface units within digital section 1120. Internal memory 1128 may store data and/or instructions for various units within digital section 1120.

Generalized audio encoder 1132 may perform encoding for input signals from an audio source 1142, a microphone 1143, etc. Generalized audio encoder 1132 may be implemented as shown in FIG. 1. Generalized audio decoder 1134 may perform decoding for coded audio data and may provide output signals to a speaker/headset 1144. Generalized audio decoder 1134 may be implemented as shown in FIG. 10. Graphics/display processor 1136 may perform processing for graphics, videos, images, and texts, which may be presented to a display unit 1146. EBI 1138 may facilitate transfer of data between digital section 1120 and a main memory 1148.

Digital section 1120 may be implemented with one or more processors, DSPs, micro-processors, RISCs, etc. Digital section 1120 may also be fabricated on one or more application specific integrated circuits (ASICs) and/or some other type of integrated circuits (ICs).

In general, any device described herein may represent various types of devices, such as a wireless phone, a cellular phone, a laptop computer, a wireless multimedia device, a wireless communication personal computer (PC) card, a PDA, an external or internal modem, a device that communicates through a wireless channel, etc. A device may have various names, such as access terminal (AT), access unit, subscriber unit, mobile station, mobile device, mobile unit, mobile phone, mobile, remote station, remote terminal, remote unit, user device, user equipment, handheld device, etc. Any device described herein may have a memory for storing instructions and data, as well as hardware, software, firmware, or combinations thereof.

The encoding and decoding techniques described herein (e.g., encoder 100 in FIG. 1, sparseness detector 116*a* in FIG. 2, sparseness detector 116*b* in FIG. 3, decoder 1000 in FIG. 10, etc.) may be implemented by various means. For example, these techniques may be implemented in hardware, firmware, software, or a combination thereof. For a hardware implementation, the processing units used to perform the techniques may be implemented within one or more ASICs, DSPs, digital signal processing devices (DSPDs), programmable logic devices (PLDs), field programmable gate arrays (FPGAs), processors, controllers, micro-controllers, microprocessors, electronic devices, other electronic units designed to perform the functions described herein, a computer, or a combination thereof.

For a firmware and/or software implementation, the techniques may be embodied as instructions on a processor-readable medium, such as random access memory (RAM), read-only memory (ROM), non-volatile random access memory (NVRAM), programmable read-only memory (PROM), electrically erasable PROM (EEPROM), FLASH memory, compact disc (CD), magnetic or optical data storage device, or the like. The instructions may be executable by one or more processors and may cause the processor(s) to perform certain aspects of the functionality described herein.

The previous description of the disclosure is provided to enable any person skilled in the art to make or use the disclosure. Various modifications to the disclosure will be readily apparent to those skilled in the art, and the generic principles defined herein may be applied to other variations without departing from the spirit or scope of the disclosure. Thus, the disclosure is not intended to be limited to the examples described herein but is to be accorded the widest scope consistent with the principles and novel features disclosed herein.

What is claimed is:

1. An apparatus comprising:

at least one processor configured to determine sparseness of an input signal in at least a time domain and a transform domain based on a plurality of parameters of the input signal, to compare the sparseness of the input signal in the time domain to the sparseness of the input signal in the transform domain, to determine at least one count based on prior selections of a time-domain encoder and prior selections of a transform-domain encoder, to select an encoder from at least the time-domain encoder and the transform-domain encoder based on the comparison and the at least one count, and to encode the input signal based on the selected encoder; and a memory coupled to the at least one processor.

2. The apparatus of claim 1, wherein the input signal is an audio signal.

3. The apparatus of claim 1, further comprising a silence encoder, wherein the at least one processor is configured to detect for activity in the input signal and to select the silence encoder if activity is not detected in the input signal.

4. The apparatus of claim 1, further comprising a noise-like signal encoder, wherein the at least one processor is configured to determine whether the input signal has noise-like signal characteristics and to select the noise-like signal encoder if the input signal has noise-like signal characteristics.

5. The apparatus of claim 1, wherein the time-domain encoder comprises a Code Excited Linear Prediction (CELP) encoder and the transform-domain encoder comprises a Modified Discrete Cosine Transform (MDCT) encoder.

6. The apparatus of claim 1, wherein the input signal comprises a sequence of frames, and wherein the at least one processor is configured to determine characteristics of each frame in the sequence, to select an encoder for each frame based on the determined characteristics of the frame, and to encode each frame based on the encoder selected for the frame.

7. The apparatus of claim 6, wherein the at least one processor is further configured to select a particular encoder for a particular frame if the particular frame and a predetermined number of preceding frames indicate a switch to the particular encoder.

8. The apparatus of claim 1, wherein the at least one processor is further configured to select the time-domain encoder to encode the input signal in the time domain if the input signal is determined to be more sparse in the time domain than in the transform domain, and to select the transform-domain encoder to encode the input signal in the transform domain if the input signal is determined to be more sparse in the transform domain than in the time domain.

9. The apparatus of claim 1, wherein the at least one processor is further configured to determine a first parameter indicative of sparseness of the input signal in the time domain, to determine a second parameter indicative of sparseness of the input signal in the transform domain, to select the time-domain encoder if the first and second parameters indicate the input signal being more sparse in the time domain than in the transform domain, and to select the transform-domain encoder if the first and second parameters indicate the input signal being more sparse in the transform domain than in the time domain.

10. The apparatus of claim 1, wherein comparing the sparseness of the input signal in the time domain to the sparseness of the input signal in the transform domain comprises:

transforming a first signal in a time domain to obtain a second signal in a transform domain, determining a first parameter and a second parameter based on the first and second signals, and determining whether the first signal or the second signal is more sparse based on the first and second parameters.

11. The apparatus of claim 10, wherein the at least one processor is further configured to transform the first signal based on a Modified Discrete Cosine Transform (MDCT) to obtain the second signal.

12. The apparatus of claim 10, wherein the at least one processor is further configured to perform Linear Predictive Coding (LPC) on the input signal to obtain residuals in the first signal, to transform the residuals in the first signal to obtain coefficients in the second signal, to determine energy values for the residuals in the first signal, and to determine energy values for the coefficients in the second signal, and to determine the first and the second parameters based on the energy values for the residuals and the energy values for the coefficients.

13. The apparatus of claim 10, wherein the at least one processor is further configured to determine that the first signal is more sparse based on the first parameter being smaller than the second parameter by a first threshold and to determine that the second signal is more sparse based on the second parameter being smaller than the first parameter by a second threshold.

14. The apparatus of claim 10, wherein the at least one processor is further configured to determine a third parameter indicative of cumulative energy of the first signal, to determine a fourth parameter indicative of cumulative energy of the second signal, and to determine whether the first signal or the second signal is more sparse further based on the third and fourth parameters.

15. The apparatus of claim 10, wherein the at least one processor is further configured to determine a first cumulative energy function for the first signal, to determine a second cumulative energy function for the second signal, to determine the first parameter based on number of times the first cumulative energy function meets or exceeds the second cumulative energy function, and to determine the second parameter based on number of times the second cumulative energy function meets or exceeds the first cumulative energy function.

16. The apparatus of claim 15, wherein the at least one processor is further configured to determine that the first signal is more sparse based on the first parameter being greater than the second parameter, and to determine that the second signal is more sparse based on the second parameter being greater than the first parameter.

17. The apparatus of claim 15, wherein the at least one processor is further configured to determine a third parameter based on instances in which the first cumulative energy function exceeds the second cumulative energy function, to determine a fourth parameter based on instances in which the second cumulative energy function exceeds the first cumulative energy function, and to determine whether the first signal or the second signal is more sparse further based on the third and fourth parameters.

18. The apparatus of claim 10, wherein the at least one processor is further configured to determine at least a second count based on prior determinations of the first signal being more sparse and prior determinations of the second signal being more sparse, and to determine whether the first signal or the second signal is more sparse further based on the at least second count.

19. The apparatus of claim 10, wherein the at least one processor is further configured to increment a second count and decrement a third count for each determination of the first signal being more sparse, to decrement the second count and increment the third count for each declaration of the second signal being more sparse, and to determine whether the first signal or the second signal is more sparse based further on the second and third counts.

20. The apparatus of claim 1, wherein information with respect to the selected encoder is sent to a receiver in response to a change of which encoder is used to generate a coded signal.

21. The apparatus of claim 13, wherein the first threshold is different from the second threshold.

22. A method comprising:

determining sparseness of an input signal in at least a time domain and a transform domain based on a plurality of parameters of the input signal;

comparing the sparseness of the input signal in the time domain to the sparseness of the input signal in the transform domain;

determining at least one count based on prior selections of a time-domain encoder and prior selections of a transform-domain encoder;

selecting an encoder from at least the time-domain encoder and the transform-domain encoder based on the comparison and the at least one count; and encoding the input signal based on the selected encoder.

23. The method of claim 22, further comprising detecting for activity in the input signal, and wherein selecting the encoder further comprises selecting a silence encoder if activity is not detected in the input signal.

24. The method of claim 22, further comprising determining whether the input signal has noise-like signal characteristics, and wherein selecting the encoder further comprises selecting a noise-like signal encoder if the input signal has noise-like signal characteristics.

25. The method of claim 22, wherein determining the sparseness of the input signal comprises determining a first parameter indicative of sparseness of the input signal in the time domain and determining a second parameter indicative of sparseness of the input signal in the transform domain, and wherein selecting the encoder further comprises selecting the time-domain encoder if the first and second parameters indicate the input signal being more sparse in the time domain than in the transform domain and selecting the transform-domain encoder if the first and second parameters indicate the input signal being more sparse in the transform domain than in the time domain.

26. The method of claim 22, wherein comparing the sparseness of the input signal in the time domain to the sparseness of the input signal in the transform domain comprises:

transforming a first signal in a time domain to obtain a second signal in a transform domain;

determining a first parameter and a second parameter based on the first and second signals; and determining whether the first signal or the second signal is more sparse based on the first and second parameters.

27. The method of claim 26, wherein determining the first and second parameters comprises:

determining the first parameter based on a minimum number of values in the first signal containing at least a particular percentage of total energy of the first signal, and determining the second parameter based on a minimum number of values in the second signal containing at least the particular percentage of total energy of the second signal.

28. The method of claim 26, further comprising:

determining a first cumulative energy function for the first signal; and determining a second cumulative energy function for the second signal and wherein determining the first and the second parameters comprises:

determining the first parameter based on a number of times the first cumulative energy function meets or exceeds the second cumulative energy function, and determining the second parameter based on a number of times the second cumulative energy function meets or exceeds the first cumulative energy function.

29. The method of claim 28, further comprising:

determining a third parameter based on instances in which the first cumulative energy function exceeds the second cumulative energy function; and determining a fourth parameter based on instances in which the second cumulative energy function exceeds the first cumulative energy function, and wherein whether the first signal or the second signal is more sparse is determined further based on the third and fourth parameters.

30. The method of claim 26, further comprising:

determining at least a second count based on prior determinations of the first signal being more sparse and prior determinations of the second signal being more sparse, and wherein whether the first signal or the second signal is more sparse is determined further based on the at least second count.

31. The method of claim 26, wherein determining that the first signal is more sparse is based on the first parameter being smaller than the second parameter by a first threshold and wherein determining that the second signal is more sparse is based on the second parameter being smaller than the first parameter by a second threshold.

32. An apparatus comprising:

means for determining sparseness of an input signal in at least a time domain and a transform domain based on a plurality of parameters of the input signal;

means for comparing the sparseness of the input signal in the time domain to the sparseness of the input signal in the transform domain;

means for determining at least one count based on prior selections of a time-domain encoder and prior selections of a transform-domain encoder;

means for selecting an encoder from at least the time-domain encoder and the transform-domain encoder based on the comparison and the at least one count; and means for encoding the input signal based on the selected encoder.

33. The apparatus of claim 32, further comprising means for detecting for activity in the input signal, and wherein the means for selecting the encoder further comprises means for selecting a silence encoder if activity is not detected in the input signal.

34. The apparatus of claim 32, further comprising means for determining whether the input signal has noise-like signal characteristics, and wherein the means for selecting the encoder further comprises means for selecting a noise-like signal encoder if the input signal has noise-like signal characteristics.

35. A processor-readable non-transitory media for storing instructions to:

determine sparseness of an input signal in at least a time domain and a transform domain based on a plurality of parameters of the input signal;

compare the sparseness of the input signal in the time domain to the sparseness of the input signal in the transform domain;

determine at least one count based on prior selections of a time-domain encoder and prior selections of a transform-domain encoder;

select an encoder from at least the time-domain encoder and the transform-domain encoder based on the comparison and the at least one count; and encode the input signal based on the selected encoder.

* * * * *